US006318106B1

(12) United States Patent
Maeda

(10) Patent No.: US 6,318,106 B1
(45) Date of Patent: Nov. 20, 2001

(54) DEHUMIDIFYING AIR CONDITIONER

(75) Inventor: Kensaku Maeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/529,035

(22) PCT Filed: Oct. 8, 1998

(86) PCT No.: PCT/JP98/04555

§ 371 Date: Apr. 6, 2000

§ 102(e) Date: Apr. 6, 2000

(87) PCT Pub. No.: WO99/19675

PCT Pub. Date: Apr. 22, 1999

(30) Foreign Application Priority Data

Oct. 9, 1997 (JP) ..... 9-293313

(51) Int. Cl.[7] ..... F25D 23/00
(52) U.S. Cl. ..... 62/271; 62/92; 62/238.3
(58) Field of Search ..... 62/271, 92, 94, 62/324.1, 238.3

(56) References Cited

U.S. PATENT DOCUMENTS

| | | | |
|---|---|---|---|
| 4,430,864 | | 2/1984 | Mathiprakasam . |
| 4,887,438 | | 12/1989 | Meckler . |
| 5,325,676 | | 7/1994 | Meckler . |
| 5,364,455 | | 11/1994 | Komarneni et al. . |
| 5,448,895 | | 9/1995 | Coellner et al. . |
| 5,718,122 | | 2/1998 | Maeda . |
| 5,758,509 | | 6/1998 | Maeda . |
| 5,761,923 | | 6/1998 | Maeda . |
| 5,761,925 | | 6/1998 | Maeda . |
| 5,791,157 | | 8/1998 | Maeda . |
| 5,816,065 | | 10/1998 | Maeda . |
| 5,878,590 | * | 3/1999 | Kadle et al. ..... 62/271 |
| 5,931,015 | | 8/1999 | Maeda . |
| 5,943,874 | | 8/1999 | Maeda . |
| 5,950,442 | | 9/1999 | Maeda et al. . |
| 5,950,447 | | 9/1999 | Maeda et al. . |
| 5,966,955 | | 10/1999 | Maeda . |

FOREIGN PATENT DOCUMENTS

| | | |
|---|---|---|
| 61-228234 | 10/1986 | (JP) . |
| 62-180720 | 8/1987 | (JP) . |
| 6-321 | 1/1994 | (JP) . |
| 8-944 | 1/1996 | (JP) . |
| 8-189667 | 7/1996 | (JP) . |

* cited by examiner

*Primary Examiner*—Henry Bennett
(74) *Attorney, Agent, or Firm*—Armstrong, Westerman, Hattori, McLeland & Naughton, LLP

(57) ABSTRACT

A dehumidifying air-conditioning apparatus has a compact arrangement including an integral combination of a heat pump as a heat source drivable by a thermal energy from an external source and a desiccant air-conditioning unit, and can achieve a high energy efficiency. The dehumidifying air-conditioning apparatus through which processing air and regenerating air flows alternately through a first desiccant 103 has an adsorption heat pump having first and second heat exchanger assemblies 10A, 10B of closed structure each having desiccant heat exchangers 1A, 1B with a second desiccant for adsorbing or desorbing a refrigerant and refrigerant heat exchangers 3A, 3B for evaporating or condensing the refrigerant. The refrigerant heat exchangers of the first and second heat exchanger assemblies communicate with each other via a path through a restriction 7. The processing air and the regenerating air flow alternately through the refrigerant heat exchangers of the first and second heat exchanger assemblies of the adsorption heat pumps, and a heating medium for driving the adsorption heat pumps is guided to and heated by the desiccant heat exchangers directly in communication with the refrigerant heat exchangers through which the regenerating air flows.

10 Claims, 12 Drawing Sheets

F / G. 7

DEHUMIDIFYING AIR CONDITIONER

TECHNICAL FIELD

The present invention relates to an air-conditioning system which employs a desiccant, and more particularly to an air-conditioning system which employs a heat pump as a heat source for heating regenerating air and cooling processing air.

BACKGROUND ART

FIG. 12 of the accompanying drawings shows a conventional air-conditioning system comprising a combination of an absorption heat pump as a heat source and an air-conditioning unit employing a desiccant, i.e., a so-called desiccant air-conditioning unit.

The conventional air-conditioning system comprises an air-conditioning unit having a path A for processing air from which moisture has been adsorbed by a desiccant rotor 103, a path B for regenerating air which is heated by a heat source and thereafter passes through the desiccant rotor 103 that has adsorbed the moisture to desorb the moisture from the desiccant, and a sensible heat exchanger 104 between the processing air from which moisture has been adsorbed and the regenerating air to be regenerated by the desiccant rotor 103 and heated by the heat source. The air-conditioning system further comprises an absorption heat pump including a first cycle as an absorption refrigeration cycle having an evaporator 3, an absorber 1, a regenerator 2, and a condenser 4 as main components, and a second cycle as an absorption refrigeration cycle having an evaporator 13, an absorber 11, a regenerator 12, and a condenser 14 as main components. The second cycle is operable at a lower temperature than the first cycle. The absorption heat pump has a heat exchange relationship 21 formed between the evaporator 3 of the first cycle and the absorber 11 of the second cycle, and a heat exchange relationship 20 formed between the condenser 4 of the first cycle and the regenerator 12 of the second cycle. The regenerating air of the air-conditioning unit is heated by a heater 120 using as a heating source the heat of absorption in the first cycle and the heat of condensation in the second cycle of the absorption heat pump, for thereby regenerating the desiccant, and the processing air of the air-conditioning unit is cooled by a cooler 115 using as a cooling heat source the heat of evaporation in the second cycle of the absorption heat pump.

The conventional air-conditioning system is arranged such that the absorption heat pump simultaneously cools the processing air and heats the regenerating air of the desiccant air-conditioning unit. Based on drive heat applied to the absorption heat pump from an external source, the absorption heat pump produces an effect of cooling the processing air. The desiccant is regenerated by the sum of the heat removed from the processing air by the operation of the heat pump and the drive heat applied to the absorption heat pump. Therefore, the drive heat applied from the external source is utilized in multiple ways for a high energy-saving effect.

However, it is necessary to provide heat medium paths 122, 123, 51 between the absorption heat pump as a heat source in the system and the heater 120 of the desiccant air-conditioning unit for passing a heat medium (hot water) therethrough. Similarly, it is necessary to provide cooling medium paths 117, 118 between the absorption heat pump and the cooler 115 of the desiccant air-conditioning unit for passing a cooling medium (chilled water). Consequently, the conventional air-conditioning system is limited to applications where the heat source and the desiccant air-conditioning unit can be installed separately from each other.

In view of the above problems, it is an object of the present invention to provide a dehumidifying air-conditioning apparatus which has a compact arrangement including an integral combination of a heat pump as a heat source driven by a thermal energy from an external source and a desiccant air-conditioning unit, and can achieve a high energy efficiency.

DISCLOSURE OF INVENTION

According to an invention defined in claim 1, there is provided a dehumidifying air-conditioning apparatus comprising a path for processing air from which moisture is adsorbed by a first desiccant and thereafter cooled by a low temperature heat source of a heat pump and a path for regenerating air which is heated by a high temperature heat source of the heat pump and thereafter passes through the first desiccant that has adsorbed the moisture to desorb the moisture from the first desiccant, the arrangement being such that the processing air and the regenerating air flow alternately through the first desiccant, characterized by at least one adsorption heat pump, as the heat pump, having first and second heat exchanger assemblies of closed structure each having a desiccant heat exchanger with a second desiccant for adsorbing or desorbing a refrigerant and a refrigerant heat exchanger for evaporating or condensing the refrigerant, said refrigerant heat exchangers of the first and second heat exchanger assemblies communicating with each other via a path through a restriction, the arrangement being such that the processing air and the regenerating air flow alternately through the refrigerant heat exchangers of the first and second heat exchanger assemblies of the adsorption heat pumps, and a heating medium for driving the adsorption heat pumps is guided to and heated by the desiccant heat exchangers directly in communication with the refrigerant heat exchangers through is which the regenerating air flows.

As described above, a desiccant air-conditioning unit for dehumidifying and regenerating the desiccant in a batch process and the adsorption heat pump for adsorbing and desorbing the refrigerant are combined with each other to provide a compact integral combination of the heat-driven heat pump and the desiccant air-conditioning unit, and make the dehumidifying air-conditioning apparatus capable of saving energy. The term "desorption" refers to an action opposite to adsorption, i.e., removal of adsorbed moisture.

According to an invention defined in claim 2, in the dehumidifying air-conditioning apparatus according to claim 1, said first desiccant comprises a rotor rotatable about a central shaft relative to the fixed paths for the processing air and the regenerating air for allowing the processing air and the regenerating air to flow alternately therethrough, said first heat exchanger assembly and said second heat exchanger assembly being radially provided in at least one pair symmetrically with respect to the central shaft and rotatable about the central shaft, the adsorption heat pump which comprises said first heat exchanger assembly and said second heat exchanger assembly being rotatable relatively to the fixed paths for the processing air and the regenerating air and a path for a heat medium as a heating source to allow said regenerating air and said processing air to flow alternately through the refrigerant heat exchangers of said first and second heat exchanger assemblies and also to guide the heating medium to the desiccant heat exchanger of said first or second heat exchanger assembly which includes the refrigerant heat exchanger through which the regenerating air flows, for thereby automatically switching a process of adsorbing moisture to and desorbing moisture from the first desiccant and a process of adsorbing a refrigerant to and desorbing a refrigerant from the second desiccant in the adsorption heat pump.

Since the batch process of adsorbing moisture to and desorbing moisture from the first desiccant air-conditioning unit and the batch process of adsorbing the refrigerant to and desorbing the refrigerant from the second desiccant in the adsorption heat pump are automatically switched by relative rotation between the paths for the processing air, the regenerating air, and the heating medium, and the desiccant for desiccant air conditioning, the desiccant heat exchanger and the refrigerant heat exchanger of the adsorption heat pump, the dehumidifying air-conditioning apparatus is of a compact, energy-saving arrangement.

According to an invention defined in claim 3, the dehumidifying air-conditioning apparatus according to claim 1 or 2 has a first sensible heat exchanger for exchanging heat between the regenerating air passing through the desiccant heat exchanger directly in communication with the refrigerant heat exchanger which is exchanging heat with the processing air, and the processing air which has passed through the first desiccant, and a second sensible heat exchanger for exchanging heat between the heating medium which has passed through the desiccant heat exchanger of the second heat exchanger assembly of the adsorption heat pump which is positioned in symmetric relationship to said first heat exchanger assembly including the refrigerant heat exchanger which is exchanging heat with the regenerating air, and the regenerating air which has passed through the refrigerant heat exchanger of the second heat exchanger assembly.

The exchanging of heat between the processing air, the regenerating air, and the heating medium air provides a high energy-saving effect.

According to an invention defined in claim 4, the dehumidifying air-conditioning apparatus according to claim 3 has a first cylindrical casing which houses therein said first desiccant, a heat transfer surface, of a heat transfer surface of said first sensible heat exchanger, for contacting the processing air which has passed through the first desiccant, a heat transfer surface, of a heat transfer surface of said second sensible heat exchanger, for contacting the regenerating air which has passed through the refrigerant heat exchanger of the second heat exchanger assembly, and the refrigerant heat exchangers of the first and second heat exchanger assemblies, a second cylindrical casing surrounding said first cylindrical casing and having the same central axis as the first cylindrical casing and a diameter greater than the diameter of the first cylindrical casing, said first cylindrical casing and said second cylindrical casing defining a space therein which houses therein a heat transfer surface, of the heat transfer surface of said first sensible heat exchanger, for contacting the regenerating air which is to pass through the desiccant heat exchanger of the first heat exchanger assembly of the adsorption heat pump, a heat transfer surface, of the heat transfer surface of said second sensible heat exchanger, for contacting the heating medium of the adsorption heat pump which has passed through the desiccant heat exchanger of the second heat exchanger assembly of the adsorption heat pump, and the desiccant heat exchangers of the first and second heat exchanger assemblies of the adsorption heat pump, and a partition disposed at ends of and within the first cylindrical casing and separating the paths for the processing air and the regenerating air which pass through the first desiccant, and partitions disposed at ends of and within the space defined between said first cylindrical casing and said second cylindrical casing and separating the paths for the heating medium and the regenerating air, all components which are surrounded by said second cylindrical casing being assembled as an assembly structure, the arrangement being such that the processing air flows into the assembly structure, passes successively through the first desiccant, the first sensible heat exchanger, and the refrigerant heat exchanger of the first heat exchanger assembly of the adsorption heat pump, and then flows out of the assembly structure into a space to be air-conditioned, the arrangement being such that the regenerating air flows into the path for the regenerating air in the space defined between the first and second cylindrical casings of said assembly structure, passes successively through the first sensible heat exchanger and the desiccant heat exchanger of the first heat exchanger assembly of the adsorption heat pump, then flows into the path for the regenerating air in the first cylindrical casing, passes successively through the refrigerant heat exchanger of the second heat exchanger assembly of the adsorption heat pump, the second sensible heat exchanger, and the first desiccant, and flows out of the assembly structure, the arrangement being such that the heating medium of the adsorption heat pump is heated by a heat source, flows into the path for the heating medium in the space defined between the first and second cylindrical casings of said assembly structure, passes successively through the desiccant heat exchanger of the second heat exchanger assembly of the adsorption heat pump and the second sensible heat exchanger, and flows out of the assembly structure, and the arrangement being such that at least the first desiccant and the first and second heat exchanger assemblies of the adsorption heat pump which are installed in said assembly structure are rotatable relatively to the paths for the processing air and the regenerating air and the heating medium of the adsorption heat pump in the assembly structure.

As described above, the assembly structure comprising the components of the desiccant air-conditioning unit, the adsorption heat pump, and the sensible heat exchangers are housed in the double cylindrical casings, and are rotatable for automatically switching a batch process of dehumidifying and regenerating the desiccant air-conditioning unit and a batch process of adsorbing and desorbing the refrigerant of the adsorption heat pump. The dehumidifying air-conditioning apparatus is therefore of a compact, energy-saving arrangement.

According to an invention defined in claim 5, in the dehumidifying air-conditioning apparatus according to claim 4, said first and second sensible heat exchangers comprise a plurality of heat pipes and are arranged radially about the central axis of the cylindrical casings such that the heat transfer surfaces are exposed to a space in the first cylindrical casing and the space defined between the first and second cylindrical casings.

The heat exchangers, which have a high heat exchange efficiency, in the form of the heat pipes can be housed in the double cylindrical casing. Thus, the dehumidifying air-conditioning apparatus is of a compact, energy-saving arrangement.

According to an invention defined in claim 6, in the dehumidifying air-conditioning apparatus according to any one of claims 1 through 5, at least a portion of the regenerating air which has regenerated the desiccant is heated for use as the heating medium of the adsorption heat pump.

Because at least a portion of the high-temperature regenerating air which has regenerated the desiccant is heated for use as the heating medium of the adsorption heat pump, the amount of heat necessary for increasing the temperature of the heating medium air may be small, so that the dehumidifying air-conditioning apparatus is an energy saver.

According to an invention defined in claim 7, in the dehumidifying air-conditioning apparatus according to claim 1, said first desiccant comprises at least two members, and the dehumidifying air-conditioning apparatus further comprises a first switching mechanism for allowing one of the members of the first desiccant to adsorb moisture in the processing air and the other of the members of the first desiccant to be regenerated by the regenerating air, a second switching mechanism for passing said regenerating air and said processing air alternately through the refrigerant heat exchangers of the first and second heat exchanger assemblies of the adsorption heat pump, and a third switching mechanism for guiding the heating medium to drive the adsorption heat pump to the desiccant heat exchanger directly in communication with the refrigerant heat exchanger through which the regenerating air flows, said first, second, and third switching mechanisms being ganged for automatically switching a process of adsorbing moisture to and desorbing moisture from the first desiccant and a process of adsorbing a refrigerant to and desorbing a refrigerant from the second desiccant in the adsorption heat pump.

As described above, a batch process of dehumidifying and regenerating the desiccant air-conditioning unit and a batch process of adsorbing and desorbing the refrigerant of the adsorption heat pump are automatically switched by the main components being fixed and the three switching mechanisms disposed respectively in the paths for the processing air, the regenerating air, and the heating medium air. Consequently, the dehumidifying air-conditioning apparatus is of a compact, energy-saving arrangement.

According to an invention defined in claim 8, the dehumidifying air-conditioning apparatus according to claim 7 has a third sensible heat exchanger for exchanging heat between the heating medium to pass through the desiccant heat exchanger directly in communication with the refrigerant heat exchanger which is exchanging heat with the processing air and to be heated by a heating source, and the processing air which has passed through the first desiccant, and a fourth sensible heat exchanger for exchanging heat between the heating medium that has passed through the desiccant heat exchanger directly in communication with the refrigerant heat exchanger which is exchanging heat with the regenerating air, and the regenerating air that has passed through the refrigerant heat exchanger of the second heat exchanger assembly.

As described above, the exchanging of heat between the processing air, the regenerating air, and the heating medium air provides a high energy-saving effect.

According to an invention defined in claim 9, the dehumidifying air-conditioning apparatus according to claim 7 or 8 operates with indoor air or a mixture of indoor air and outdoor air as the processing air, and also with outdoor air or a mixture of outdoor air and discharged indoor air as the regenerating air and the heating medium.

According to an invention defined in claim 10, in the dehumidifying air-conditioning apparatus according to claim 9, said third switching mechanism is shifted in a direction different from a mode of operation according to claim 9, for guiding the heating medium to the desiccant heat exchanger directly in communication with the refrigerant heat exchanger through which the indoor air or the mixture of the indoor air and the outdoor air flows to heat the space to be air-conditioned.

By shifting the switching mechanism disposed in the path for the heating medium air in an opposite direction to the direction for a cooling mode, the dehumidifying air-conditioning apparatus can be operated in a heating mode with the same apparatus arrangement.

Best Mode for Carrying Out the Invention

Figure 1:
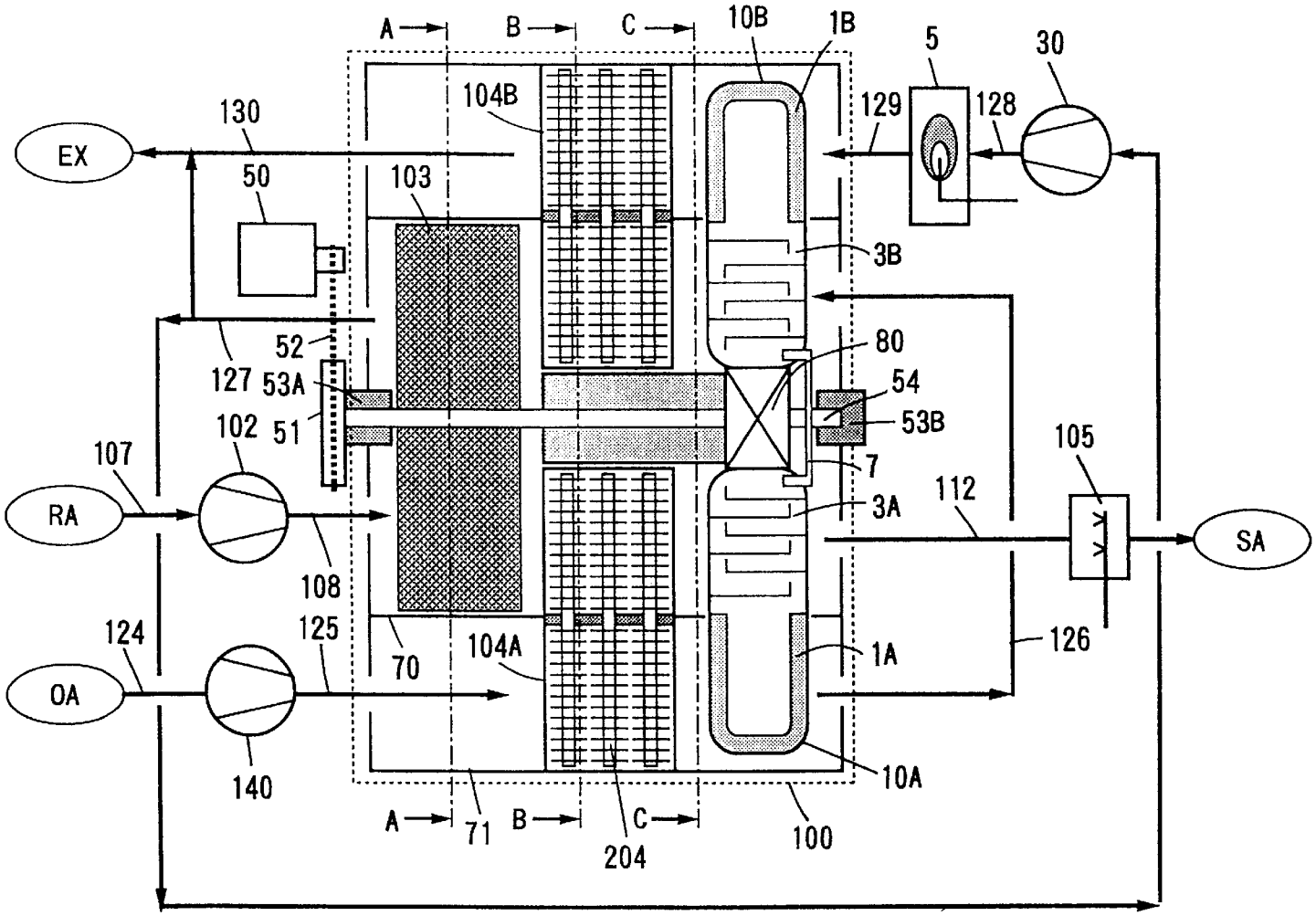
FIG. 1 is a view showing a basic arrangement of a dehumidifying air-conditioning apparatus according to a first embodiment of the present invention.
Figure 2:
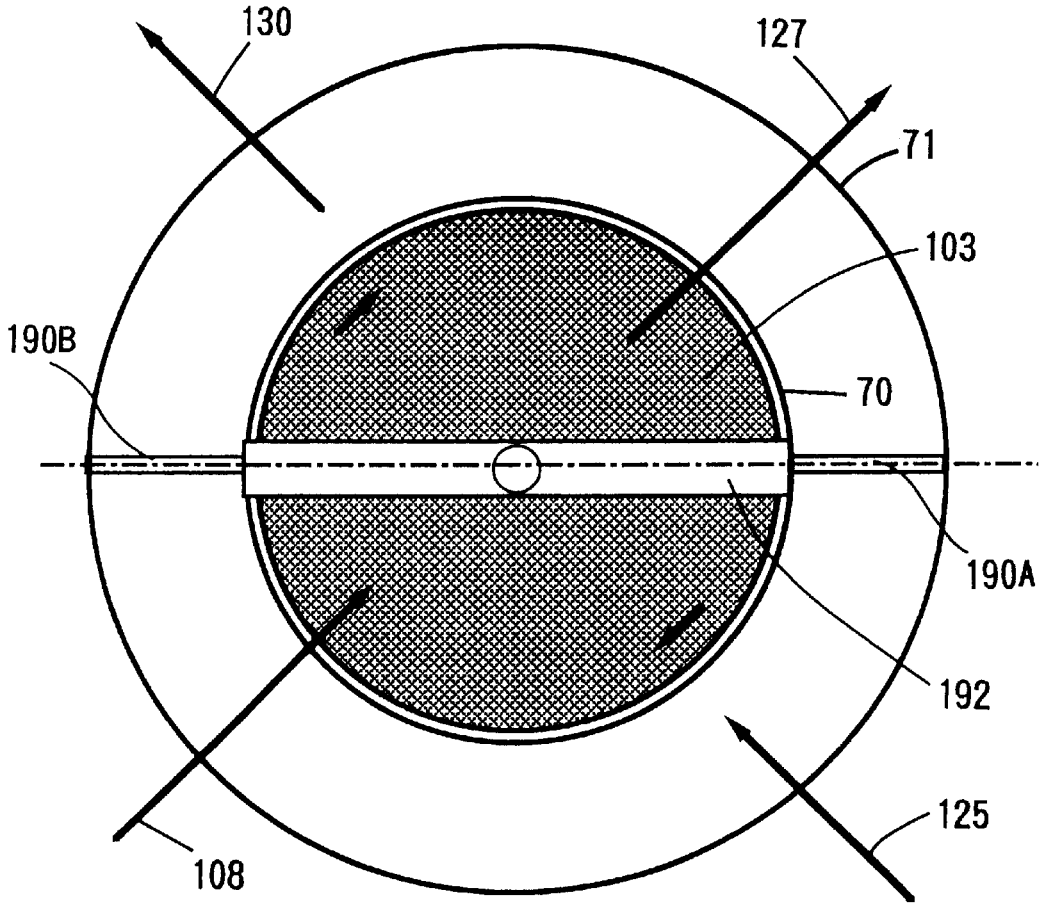
FIG. 2 is a cross-sectional view taken along line A—A of FIG. 1.
Figure 3:
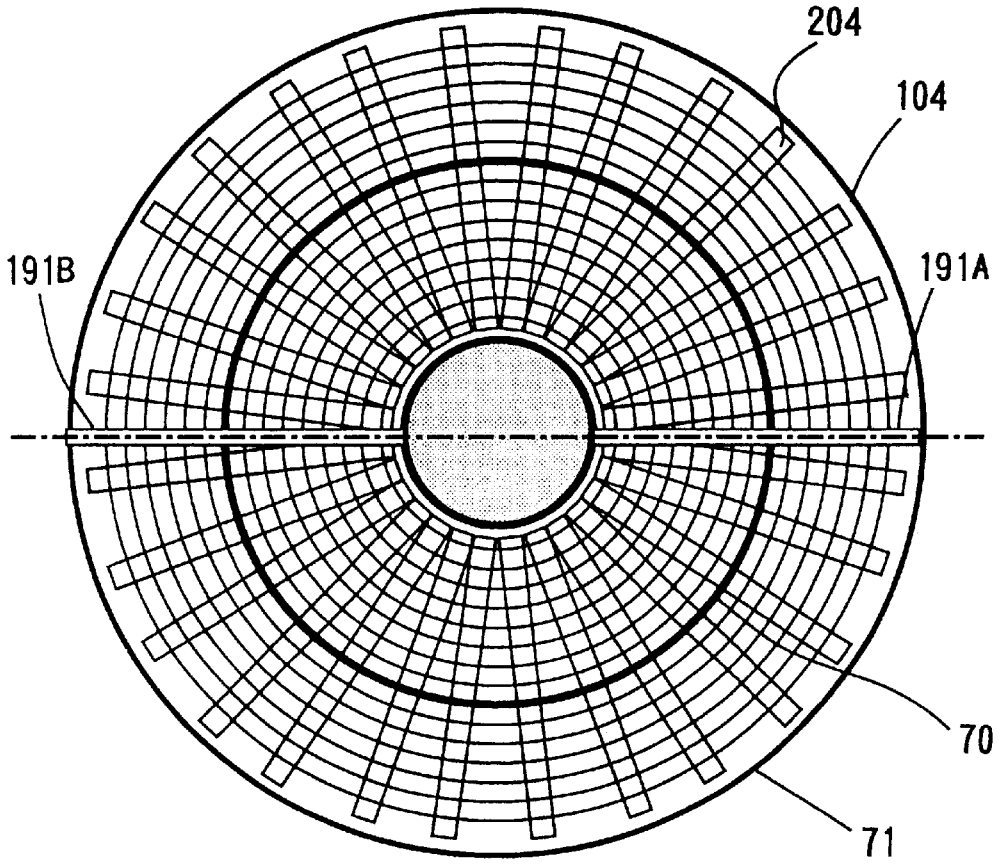
FIG. 3 is a cross-sectional view taken along line B—B of FIG. 1.

Embodiments of dehumidifying air-conditioning apparatus according to the present invention will be described below with reference to the drawings. FIG. 1 is a view showing a basic arrangement of a dehumidifying air-conditioning apparatus according to a first embodiment of the present invention, FIG. 2 is a cross-sectional view taken along line A—A of FIG. 1, FIG. 3 is a cross-sectional view taken along line B—B of FIG. 1, and FIG. 4 is a cross-sectional view taken along line C—C of FIG. 1.

Figure 4:
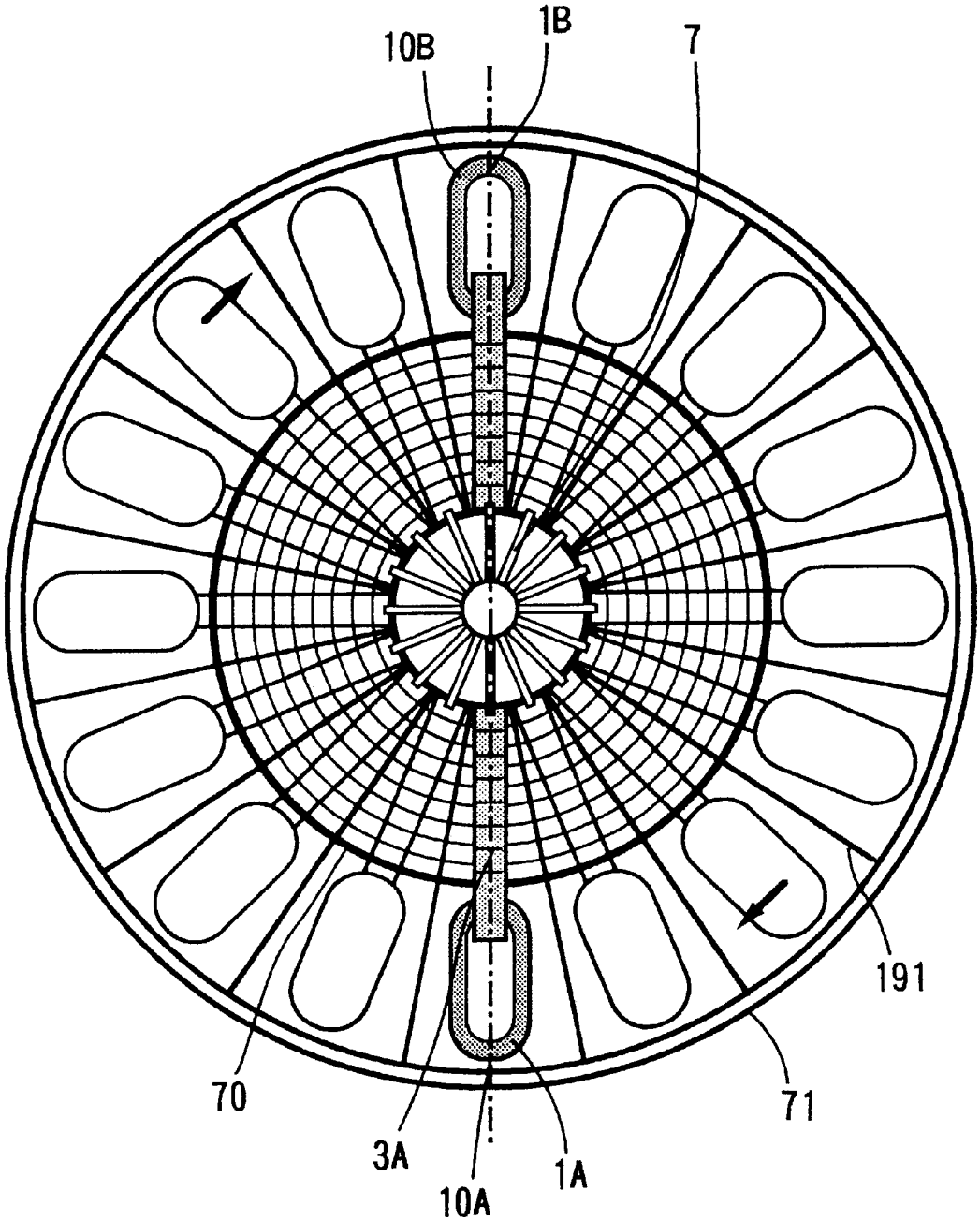
FIG. 4 is a cross-sectional view taken along line C—C of FIG. 1.

As shown in FIGS. 1 and 4, the dehumidifying air-conditioning apparatus according to the first embodiment has a plurality of adsorption heat pumps each comprising a first heat exchanger assembly 10A of closed structure having a desiccant heat exchanger 1A containing a desiccant (second desiccant) such as silica gel, zeolite, or activated carbon attached to a heat transfer surface, for cooling the desiccant via the heat transfer surface to adsorb a refrigerant such as water or alcohol sealed therein or for heating the desiccant via the heat transfer surface to desorb (regenerate) the refrigerant, and a refrigerant heat exchanger 3A for evaporating or condensing the refrigerant. The desiccant heat exchanger 1A and the refrigerant heat exchanger 3A communicate with each other via a path. Each adsorption heat pumps further comprises a second heat exchanger assembly 10B identical in construction to the first heat exchanger assembly 10A. The refrigerant heat exchanger 3A of the first heat exchanger assembly 10A and the refrigerant heat exchanger 3B of the second heat exchanger assembly 10B communicate with each other via a restriction 7.

In this embodiment, the first heat exchanger assemblies 10A, each comprising the desiccant heat exchanger 1A and the refrigerant heat exchanger 3A, and the second heat exchanger assemblies 10B of the adsorption heat pumps are symmetrically arranged radially around a central shaft 54 and rotatable about the central shaft 54. The adsorption heat pumps which comprise the first heat exchanger assemblies 10A and the second heat exchanger assemblies 10B rotate relatively to fixed paths for processing air, regenerating air, and a heat medium as a heating source for alternately passing the processing air and the regenerating air through the refrigerant heat exchangers 3A, 3B of the first and second heat exchanger assemblies 10A, 10B, and introducing the heating medium into the desiccant heat exchangers 1B (1A) directly communicating with the refrigerant heat exchangers 3B (3A) through which the regenerating air flows. A dehumidifying desiccant (first desiccant) 103 open to the atmosphere, such as of silica gel, zeolite, or the like, comprises a rotor rotatable about the central shaft 54. The desiccant 103 rotates relatively to the fixed paths for the processing air and the regenerating air to cause the processing air and the regenerating air to pass alternately through the desiccant 103. Heat is exchanged between the regenerating air which is to pass through the desiccant heat exchanger 1A (1B) directly in communication with the refrigerant heat exchanger 3A (3B) which is exchanging heat with the processing air and the processing air which has passed through the first desiccant 103. Heat is exchanged between the heating medium which has passed through the desiccant heat exchanger 1B (1A) directly in communication with the refrigerant heat exchanger 3B (3A) which is positioned in symmetric relationship to the heat exchanger assembly 10A and is exchanging heat with the regenerating air, and the regenerating air which has passed through the refrigerant heat exchanger 3B (3A) of the second (first) heat exchanger assembly 10A (10B). In order to perform the above function, the dehumidifying air-conditioning apparatus is constructed as follows:

The dehumidifying air-conditioning apparatus has a first cylindrical casing 70 and a second cylindrical casing 71 surrounding the first cylindrical casing 70 and having the same central axis as the first cylindrical casing 70 and a diameter greater than the diameter of the first cylindrical casing 70. The first desiccant 103 and refrigerant heat exchangers 3A, 3B of the first and second heat exchanger assemblies 10A, 10B of the adsorption heat pumps are housed in the first cylindrical casing 70. The desiccant heat exchangers 1A, 1B of the first and second heat exchanger assemblies 10A, 10B of the adsorption heat pumps are housed in a space defined between the first cylindrical casing and the second cylindrical casing. A heat exchanger having two functions of sensible heat exchangers 104A, 104B comprises a plurality of heat pipes 204 arranged radially around the central shaft 54 of the cylindrical casing and having heat transfer surfaces for discharging and absorbing heat which are exposed in the first cylindrical casing and the space defined between the first cylindrical casing and the second cylindrical casing 71. The central shaft 54 for rotating the first desiccant 103 is supported by bearings 53A, 53B, and can be rotated by a motor 50 through a cogged belt 52 and a pulley 51. The central shaft 54 rotates the radially arranged first and second heat exchanger assemblies 10A, 10B of the adsorption heat pumps via a speed reducer 80. The above components make up an assembly structure 100 as a whole.

The sensible heat exchangers 104A, 104B include the first sensible heat exchanger 104A which exchanges heat between the regenerating air which is to pass through the desiccant heat exchanger 1A (1B) directly in communication with the refrigerant heat exchanger 3A (3B) which is exchanging heat with the processing air, and the processing air which has passed through the first desiccant 103, and the second sensible heat exchanger 104B which exchanges heat between the heating medium which has passed through the desiccant heat exchanger 1B (1A) of the second (first) heat exchanger assembly 10B (10A) which is positioned in symmetric relationship to the heat exchanger assembly 10A of the adsorption heat pump including the refrigerant heat exchanger 3B (3A) which is exchanging heat with the regenerating air, and the regenerating air which has passed through the refrigerant heat exchanger 3B (3A) of the second (first) heat exchanger assembly 10A (10B). As shown in the cross section B—B of FIG. 3, the sensible heat exchangers 104A, 104B can perform their operation separately with partitions 191A, 191B interposed therebetween, and are of an integral structure supported by the second cylindrical casing 71.

The assembly structure 100 has a partition (e.g., 192) disposed at ends of and within the first cylindrical casing 70 and separating paths for the processing air and the regenerating air which pass through the first desiccant 103, and partitions (e.g., 190A, 190B) disposed at ends of and within the space defined between the first cylindrical casing 70 and the second cylindrical casing 71 and separating paths for the heating medium and the regenerating air.

The path for the processing air is arranged such that the processing air flows through a path 107, an air blower 102, and a path 108 into the assembly structure 100, passes successively through the sensible heat exchanger 104 and the refrigerant heat exchangers 3A of the heat exchanger assemblies 10A of the adsorption heat pumps out of the assembly structure 100, and is supplied via a path 112 and a humidifier 105 into a space to be air-conditioned. The path for the regenerating air is arranged such that the regenerating air flows through a path 124, an air blower 140, and a path 125 into the assembly structure 100, passes through the path for the regenerating air in the space between the first and second cylindrical casings and successively through the (first) sensible heat exchanger 104A and the desiccant heat exchangers 1A of the first heat exchanger assemblies 10A of the adsorption heat pumps and then through a path 126 into the path for the regenerating air in the first cylindrical casing, and passes successively through the refrigerant heat exchangers 3B of the second heat exchanger assemblies 10B of the adsorption heat pumps which are positioned in symmetric relationship to the heat exchanger assemblies 10A of the adsorption heat pumps, the (second) sensible heat exchanger 104B, and the first desiccant 103 out of the assembly structure 100. The path for the heating medium air in the adsorption heat pumps is arranged such that the heating medium air is branched from an outlet path 127 for the regenerating air, flows through an air blower 30, a path 128, a combustion chamber 5, and a path 129 into the path for the heating medium in the space between the first and second cylindrical casings of the assembly structure 100, and passes successively through the desiccant heat exchangers 1B of the second heat exchanger assemblies 10B of the adsorption heat pumps and the (second) sensible heat exchanger 104B out of the assembly structure 100.

Figure 5:
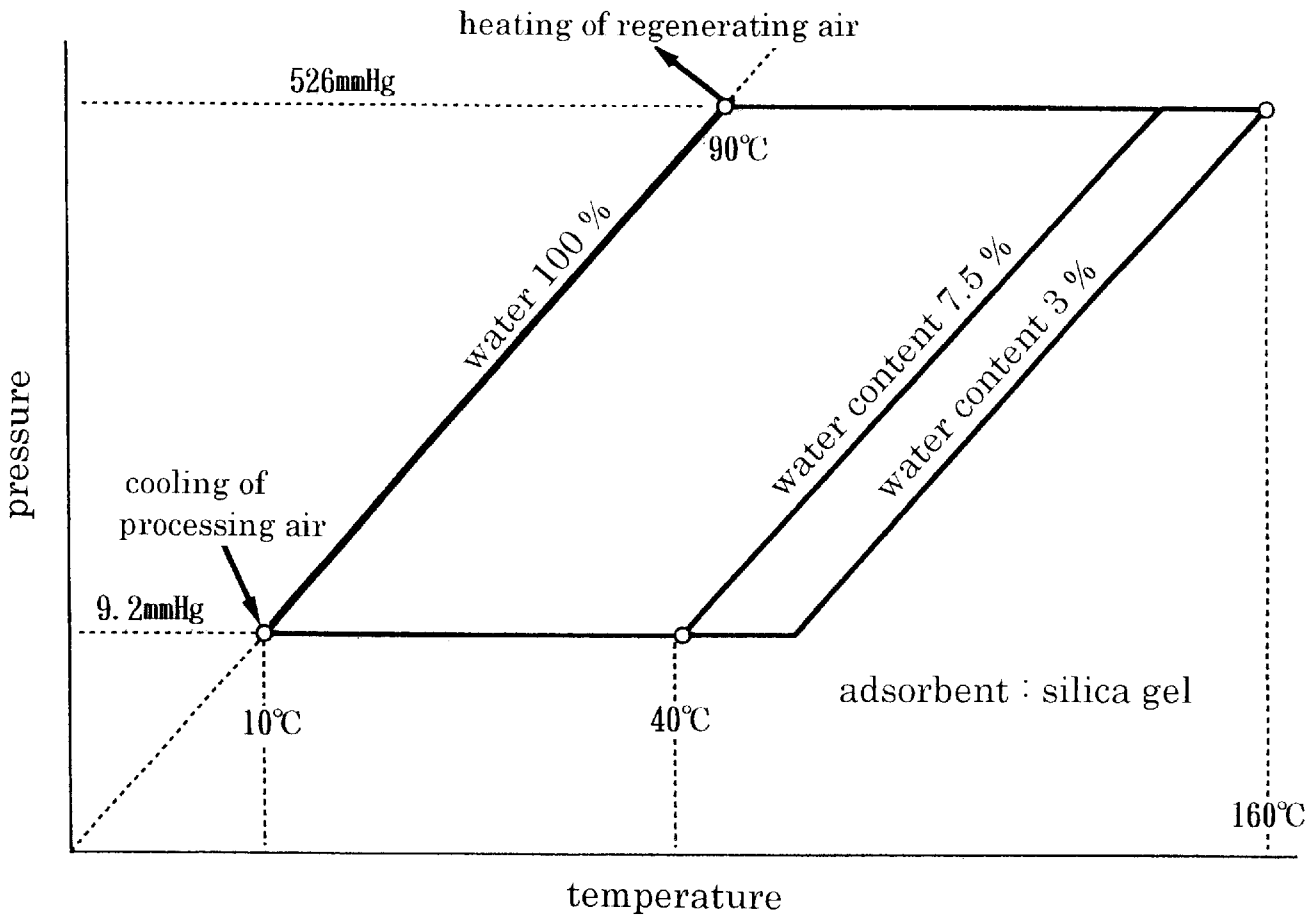
FIG. 5 is a Dühring diagram showing a refrigeration cycle of an adsorption heat pump.
Figure 6:
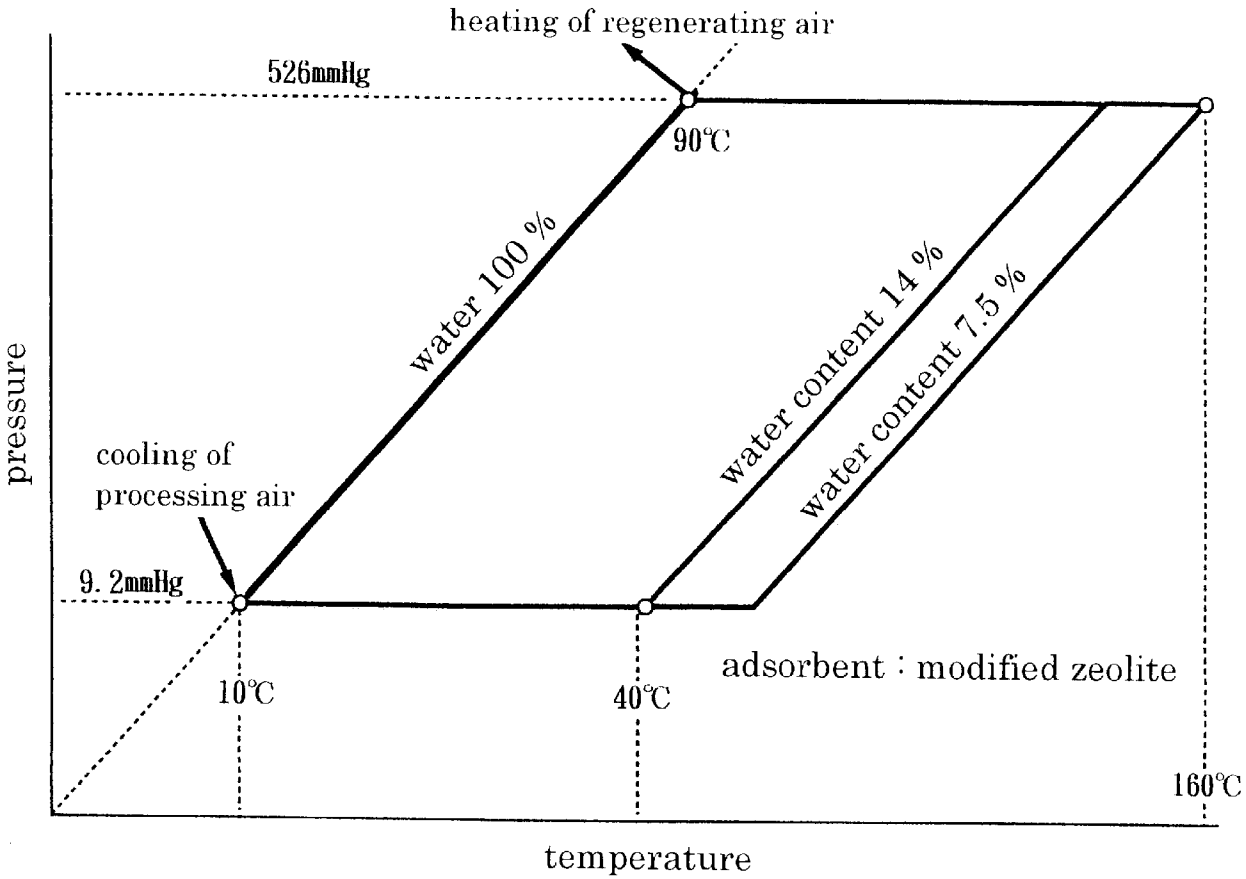
FIG. 6 is a Dühring diagram showing a refrigeration cycle of an adsorption heat pump.
Figure 7:
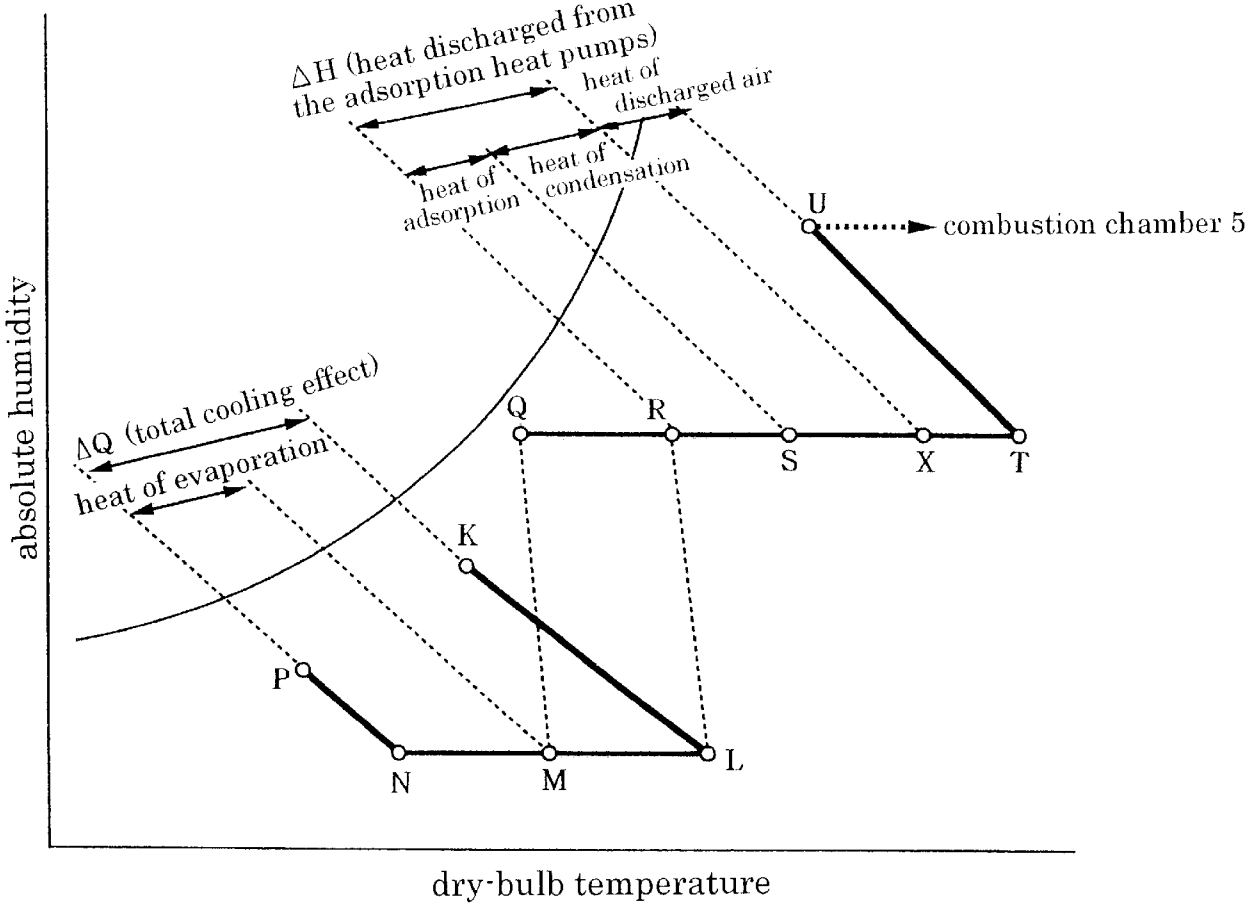
FIG. 7 is a psychrometric chart showing changes in the state of air.

Operation of the first embodiment shown in FIGS. 1 through 4 will be described below with reference to FIGS. 5 through 7. FIGS. 5 and 6 are Dühring diagrams showing operation of the adsorption heat pumps, and FIG. 7 is a psychrometric chart showing changes in the state of air.

Prior to describing overall operation of the first embodiment, operation of the adsorption heat pumps will briefly be described below.

The adsorption heat pumps used in the present invention have an operation temperature range that is different from that of adsorption chilling machines that are normally in use. Specifically, an evaporation temperature does not need to be lowered to a dew point temperature in order to cool the air that has been dehumidified by a desiccant, but the adsorption heat pumps are operated at an evaporation temperature of about 10° C. which is higher than that of the conventional adsorption chilling machines. Since the heat of adsorption is partly removed using outdoor air and discharged indoor air as the regenerating air, the adsorption heat pumps are operated at an adsorption temperature of about 40° C. which is substantially the same as that of the conventional adsorption chilling machines. These operation details are essentially the same as the operation of the usual adsorption chilling machines. However, if the adsorption heat pumps are operated at a condensation temperature of 90° C. or higher as a heat source temperature because the heat of condensation is used to regenerate the desiccant, then the desiccant air-conditioning unit can have a large dehumidifying effect thereby to achieve a compact arrangement, which is the object of the present invention. Therefore, the adsorption heat pumps need to be operated at 90° C., and have a feature which is largely different from the adsorption chilling machines that are normally in use. The reason why such an adsorption refrigerating cycle is feasible will be described below.

FIG. 5 is a Dühring diagram showing an adsorption refrigerating cycle using silica gel as an adsorbent and water as a refrigerant. In FIG. 5, the heating source temperature is 160° C., and the percentage of water content of the silica gel is 7.5% at the end of adsorption and 3% at the end of desorption, thus accomplishing a heat pump cycle which is the object of the present invention. FIG. 6 is a Dühring diagram showing an adsorption refrigerating cycle using modified zeolite as an adsorbent and water as a refrigerant. In FIG. 6, the heating source temperature is 160° C., and the percentage of water content of the modified zeolite is 14% at the end of adsorption and 7.5% at the end of desorption, thus similarly accomplishing a heat pump cycle which is the object of the present invention.

The adsorption heat pumps according to the first embodiment of the present invention operate as follows:

In FIG. 1, when the desiccant heat exchanger 1B of the second heat exchanger assembly 10B is heated by heating medium air from outside, the desiccant generates a refrigerant by depriving the heating medium air of the heat of adsorption, and the refrigerant is condensed by exchanging heat with outside regenerating air with the refrigerant heat exchanger 3B. At this time, the heat of condensation is discharged from the refrigerant heat exchanger 3B into the regenerating air. The condensed refrigerant is reduced in pressure while flowing through a restriction path 7, and flows into the first heat exchanger assembly 10A where it exchanges heat with outside processing air with the refrigerant heat exchanger 3A, so that the refrigerant is evaporated. At this time, the outside processing air is deprived of the heat of evaporation, causing the refrigerant heat exchanger 3A to produce a cooling effect. The evaporated refrigerant is adsorbed by the desiccant of the desiccant heat exchanger 1A which is cooled by other outdoor air (regenerating air). At this time, the heat of adsorption is discharged into the outdoor air (regenerating air) from the desiccant heat exchanger 1A. When the desiccant of the desiccant heat exchanger 1A is saturated by the refrigerant and its adsorption capability is lowered, the first heat exchanger assembly 10A and the second heat exchanger assembly 10B are positionally switched by rotating the rotating shaft 54. Then, the same operation as described above is carried out. In this manner, the cooling effect and the heating effect are successively generated by a batch process. This operation is known to those skilled in the art, and will not be described in greater detail.

The operation of an air cycle will be described below with reference to FIG. 7. As shown in FIG. 1, according to the first embodiment, recirculating indoor air (RA) is used as the processing air, outdoor air (OA) as the regenerating air, and a portion of the discharged regenerating air as the heating medium. For desiccant air conditioning, as is well known in the art, outdoor air or a mixture of outdoor air and recirculating indoor air may be used as the processing air, and discharged indoor air or a mixture of discharged indoor air and outdoor air may be used as the regenerating air.

The processing air (state K) flows through the path 107, the air blower 102, and the path 108 into the assembly structure 100, and is lowered in humidity and increased in temperature (state L) as moisture in the processing air is adsorbed by the first desiccant 103. The dehumidified air exchanges heat with outdoor air (state Q) in the (first) sensible heat exchanger 104A, and is lowered in temperature (state M). The dehumidified air is then cooled by the refrigerant heat exchanger 3A of the adsorption heat pump that is operating as an evaporator (state N). The dehumidified air flows out of the assembly structure 100 through the path 112 into the humidifier 105. The dehumidified air is humidified in an isenthalpic process by the humidifier 105 (state P), and supplied to the space to be air-conditioned (SA).

The regenerating air (state Q) flows through the path 124, the air blower 140, and the path 125 into the assembly structure 100, and flows through the path for the regenerating air in the space between the first and second cylindrical casings into the (first) sensible heat exchanger 104A in which the regenerating air exchanges heat with the processing air (state L) and is increased in temperature (state R). The regenerating air whose temperature has increased is heated by the desiccant heat exchanger 1A of the first heat exchanger assembly 10A of the adsorption heat pump which is operating as an adsorber (state S), flows through the path 126, and is further heated by the refrigerant heat exchanger 3B of the second heat exchanger assembly 10B of the adsorption heat pump which is operating as a condenser, positioned in symmetric relationship to the first heat exchanger assembly 10A of the adsorption heat pump (state X). The regenerating air which has left the refrigerant heat exchanger 3B is further heated by exchanging heat with the heating medium air that has been heated by a regenerator in the (second) sensible heat exchanger 104B (state T), after which the regenerating air passes through the first desiccant 103 to regenerate the desiccant, and is humidified and lowered in temperature (state U). The regenerating air that has passed through the first desiccant and flowed out of the assembly structure 100 is partly discarded out as discharged air (EX), with the remaining regenerating air being used as heating medium air.

The heating medium air of the adsorption heat pump (state U) is branched from the outlet path 127 for the regenerating air, and flows through the air blower 30 and the path 128 into the combustion chamber 5, in which the heating medium air is heated to a high temperature of 160° C. or higher by combustion gases. The heated heating medium air flows through the path 129 into the path for the heating medium in the space between the first and second cylindrical casings of the assembly structure 100, and flows into the desiccant heat exchanger 1B of the second heat exchanger assembly 10B of the adsorption heat pump which is operating as a regenerator. After having heated the desiccant heat exchanger 1B, the heating medium air flows into the (second) sensible heat exchanger 104B and exchanges heat with the regenerating air of the state X to transfer excessive heat thereto. The heating medium air then flows out of the assembly structure 100, and is discarded out as discharged air via a path 130.

When the shaft 54 rotates in the assembly structure 100, the adsorption heat pumps comprising the first heat exchanger assemblies 10A and the second heat exchanger assemblies 10B are rotated relatively to the fixed paths for the processing air, the regenerating air, and the heat medium as a heating source, and the dehumidifying desiccant 103 is rotated relatively to pass the processing air and the regenerating air alternately. Therefore, a batch process for dehumidifying and regenerating the desiccant air-conditioning unit and a batch process for adsorbing and desorbing the refrigerant of the adsorption heat pumps are automatically switched over for successive operation.

In this embodiment, the heat exchanger assemblies 10A, 10B of the adsorption heat pumps rotate more slowly at a certain speed reduction ratio than the dehumidifying desiccant 103. However, since a period optimum for switching between the adsorption and desorption cycles of the adsorption heat pumps and a period optimum for switching between the dehumidification and regeneration of the dehumidifying desiccant 103 may not necessarily be handled at the same speed reduction ratio if the operating conditions are changed, separate actuators may be used to drive the heat exchanger assemblies 10A, 10B and the dehumidifying desiccant 103.

For example, the desiccant rotor of the desiccant air-conditioning unit is rotated usually at a speed ranging from 20 to 30 revolutions per hour. In this case, the period for switching between batch processes ranges from 2 to 3 minutes, and is too fast for switching cycles for the adsorption heat pumps. Therefore, it is necessary to reduce the rotational speed of the desiccant rotor to a speed ranging from 4 to 8 revolutions per hour with a speed reducer for rotating the heat exchanger assemblies 10A, 10B of the adsorption heat pumps. However, if it is possible to increase the heat transfer capability of the adsorption heat pumps to increase the rate at which the refrigerant is adsorbed to and desorbed from the desiccant, the desiccant rotor can be rotated at a higher speed.

In the dehumidifying air-conditioning apparatus which operates as described above according to the present invention, the drive heat applied from outside is used to drive the adsorption heat pumps to produce a cooling effect due to the heat of evaporation of the refrigerant, and the heat discharged from the adsorption heat pumps and the heat recovered from the discharged air are used to regenerate the desiccant of the desiccant air-conditioning unit, adding a cooling effect owing to the desiccant air-conditioning cycles. Therefore, a large energy-saving effect is obtained. Details of such a large energy-saving effect will be described below.

As well known in the art, the coefficient of performance (COP) of an adsorption heat pump is generally in the range from 0.4 to 0.5. Therefore, when heat in a unit of 1 is applied from an external heat source, the quantity of heat ranging from 1.4 to 1.5 is discharged out via an adsorber and a condenser. In this embodiment, the heat recovered from the discharged air is also added. Referring to the example of a gas-operated absorption heater chiller whose operating conditions are similar, the temperature of a heating medium after combustion is 1600° C. at the inlet of a regenerator and 200° C. at the outlet of the regenerator, and if it is assumed that heat is recovered from the heating medium at the outlet of the regenerator to a temperature of 120° C. at which no drain is produced, then since the quantity of heat of (200–120)/(1600–200)=0.057 can be recovered from the quantity of heat of 1, the quantity of heat ranging from (1.4+0.057) to (1.5+0.057) , i.e., the quantity of heat ranging from 1.45 to 1.56, can be obtained, and the first desiccant can be regenerated with the obtained heat. While the coefficient of performance (COP) of the desiccant air-conditioning cycles using the first desiccant 103 in the present embodiment differs with the regenerating temperature, if the regenerating air at about 90° C. is used as in this embodiment, then it is reported that the coefficient of performance of 0.8 or larger can be obtained, from known materials (known example 1, known example 2).

Known example 1: Literature; U.S. ASHRAE Transactions: Symposia IN-91-4-2, pp 609–614, "SIMULATION OF ADVANCED GAS-FIRED DESICCANT COOLING SYSTEMS".

Known example 2: Literature; U.S. Energy Engineering Vol. 93, No. 1, 1996, pp 6–16, "Advances in Desiccant Technologies".

Therefore, when the desiccant air-conditioning unit is driven by the quantity of thermal energy ranging from 1.46 to 1.56, the quantity of cooling effect ranging from 0.16 to 1.25, produced by multiplying the above quantity of thermal energy by 0.8 is obtained. As shown in FIG. 7, because the quantity of total cooling effect is produced by adding the quantity of cooling effect of the adsorption heat pumps (process M-N) ranging from 0.4 to 0.5 to the quantity of cooling effect of the desiccant cycle (process L-M), the quantity of cooling effect ranging from (1.16+0.4) to (1.25+0.5), i.e., the quantity of cooling effect ranging from 1.56 to 1.75, is obtained. Since the above calculation is based on the assumption that the quantity of the drive heat is 1, the coefficient of performance (COP) of the overall apparatus is also in the range from 1.56 to 1.75. As a result, there is obtained a very high energy-saving effect which is 51% to 54% higher than conventional desiccant air-conditioning units, and 23% to 32% higher than double-effect absorption heater chiller which have a coefficient of performance of 1.2.

The dehumidifying air-conditioning apparatus of the above construction is rendered highly compact for the following reasons:

The total amount of the second desiccant of the adsorption heat pumps which is required to produce the above performance is calculated as follows: It is assumed that an air-conditioning apparatus is capable of achieving one USRT (3024 kcal/h), and has a minimum coefficient of performance. From the above calculations, a cooling effect produced by the adsorption heat pump is given by:

$$Qe=3024\times0.4/1.56=775\ kcal/h.$$

Inasmuch as the cooling effect obtained from a condensed refrigerant at 90° C. (water/enthalpy of 90 kcal/kg) and a saturated steam at 10° C. (enthalpy of 602 kcal/kg) is 512 kcal/kg, a circulating rate of the refrigerant for achieving the cooling effect of 775 kcal/h is $$775/512=1.51 \text{ kg/h}.$$

Therefore, if the switching period for adsorption and desorption of the adsorption heat pump is 10 minutes, then the adsorption is carried out three times per hour, and hence a desiccant for adsorption and desorption is required in the amount of:

$$1.51/3=0.503 \text{ kg}.$$

From FIGS. 5 and 6, if silica gel is used as the desiccant, then the desiccant is required for adsorption in the amount of:

$$0.503/(0.075-0.03)=11.1 \text{ kg}.$$

If modified zeolite is used as the desiccant, then the desiccant is required for adsorption in the amount of:

$$0.503/(0.14-0.75)=7.7 \text{ kg}.$$

Consequently, the desiccant in the amount twice the above values is required to cover the cooling process, i.e., 22.2 kg of the desiccant in the form of silica gel or 15.4 kg of the desiccant in the form of zeolite is needed. If these weights are to be converted into volumes, then since the normal packing density of the dehumidifier is about 750 g/l, silica gel is needed in a volume of 29.6 liters and zeolite is needed in a volume of 20.5 liters.

The dimensions of the first desiccant rotor of the desiccant air-conditioning unit will be calculated below. Usually, a desiccant rotor having a diameter of about 100 cm and a thickness of about 20 cm is normally used for achieving 5 USRT (15,120 kcal/h). In this embodiment, since the cooling capability of the desiccant air-conditioning unit per USRT is 1×1.16/1.56=0.74 USRT from the above calculated example, the diameter of the first desiccant rotor is calculated as follows:

$$100\times(0.74/5)^{1/2}=38.4 \text{ cm}$$

(it needs to have the same thickness of 20 cm). If the first cylindrical casing 70 has a diameter of about 40 cm and the second cylindrical casing 71 has a diameter of 70 cm, then the space between the first cylindrical casing 70 and the second cylindrical casing 71, where the desiccant heat exchangers 1A, 1B of the adsorption heat pumps are located, has a cross-sectional area of 2592 $cm^2$. If it is assumed that the desiccant in the desiccant heat exchangers of the adsorption heat pumps takes up 40% of this partial volume, then the axial length is as follows:

$$29.6\times1000/2592/0.4=28.5 \text{ cm}.$$

The dimensions of the sensible heat exchanger 104 will be calculated below. If a target temperature efficiency for the sensible heat exchanger is 75%, then the number of transfer units (NTU) needs to be about 3.0. As well known in the art, the NTU is expressed by the following equation:

$$NTU=KA/GC$$

where G represents the rate of weight flow of air, C the specific heat of air, K the overall heat transfer coefficient, and A the heat transfer area. Since the rate of flow of air for performing a cooling capability of one USRT is about 300 kg/h and the overall heat transfer coefficient based on the heat transfer surface of fins of a heat pipe is about 15 kcal/hC, the required area of the fins is calculated as follows:

$$A=NTU\cdot GC/K=3\times300\times0.24/15=14.4 \text{ m}^2.$$

The length of fins that can be installed inside the first cylindrical casing is calculated as follows: If fins are to be placed at a fin pitch of 2.54 mm in a range of radii from 5 cm to 20 cm, then since the cross-sectional length of the fins appearing in the cross section B—B is:

$$(5+20)/2\times2\delta\times(20-5)/0.254=4634 \text{ cm},$$

the axial length of the fins is given as:

$$14.4\times10000/4634=31 \text{ cm}.$$

Therefore, the required axial length of the assembly structure is equal to the sum of the thickness of the first desiccant which is 20 cm, the length of the sensible heat exchanger 104 which is 31 cm, and the thickness of the adsorption heat pumps which is 28.5 cm, and a slight clearance. The axial length of the assembly structure, except for the slight clearance, is:

$$20+31+28.5=79.5 \text{ cm}.$$

Consequently, the assembly structure 100 having a cooling capability of one USRT can be constructed within a cylindrical shape having a diameter of about 70 cm and a length of about 90 cm.

According to the present embodiment, as described above, a highly compact air-conditioning apparatus can be realized. While the assembly structure 100 is installed horizontally in the present embodiment, the shaft 54 may be installed vertically.

Figure 8:
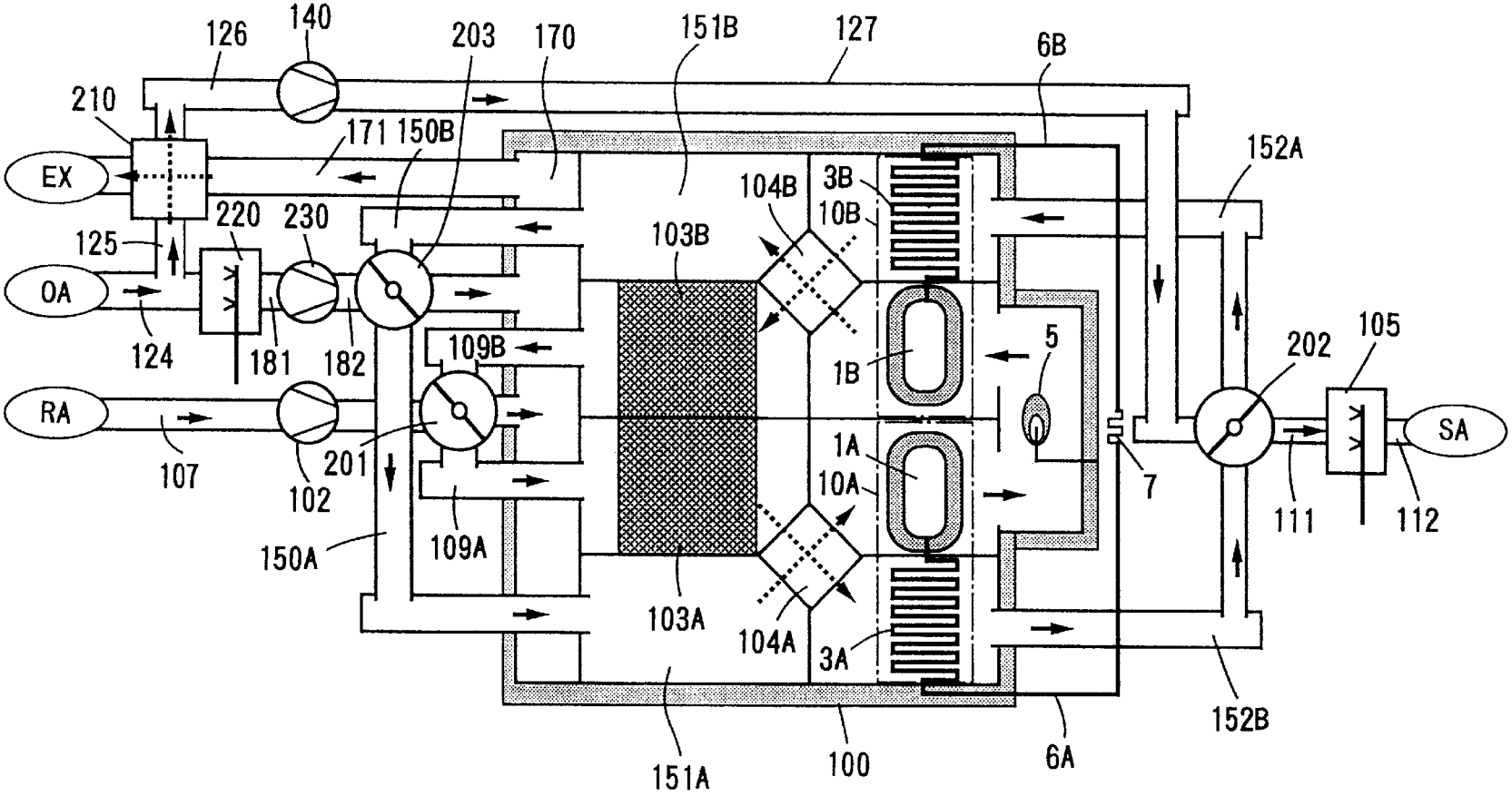
FIG. 8 is a view showing a basic arrangement of a dehumidifying air-conditioning apparatus according to a second embodiment of the present invention.
Figure 9:
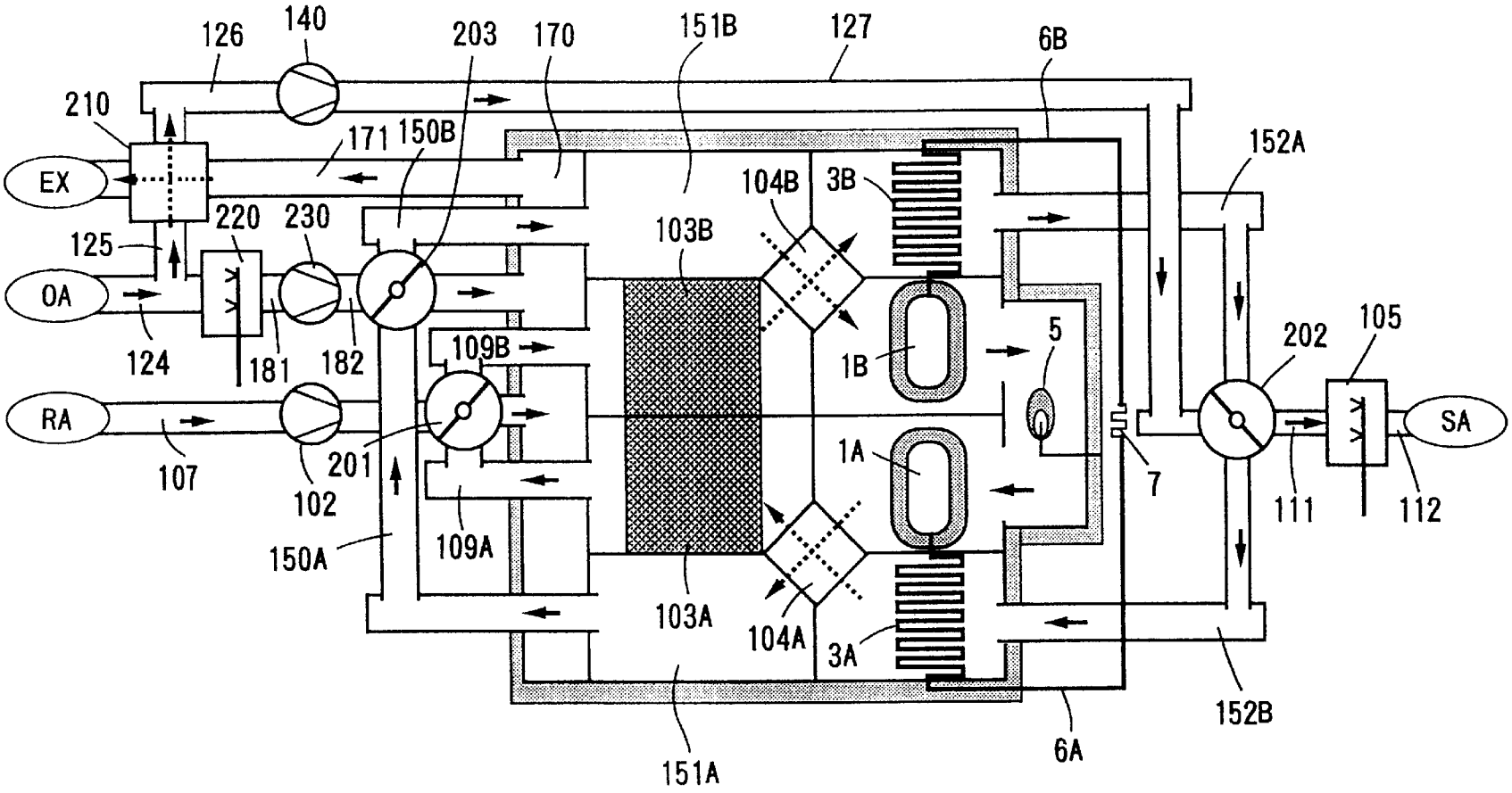
FIG. 9 is a view of the dehumidifying air-conditioning apparatus according to the second embodiment, showing a mode of operation in which first through third switching mechanisms are switched to directions different from those shown in FIG. 8.

FIG. 8 is a view showing a basic arrangement of a dehumidifying air-conditioning apparatus according to a second embodiment of the present invention, and FIG. 9 is a view of the dehumidifying air-conditioning apparatus according to the second embodiment, showing a mode of operation in which first through third switching mechanisms are switched to directions different from those shown in FIG. 8.

According to the second embodiment, as with the first embodiment, as shown in FIG. 8, the dehumidifying air-conditioning apparatus has a plurality of adsorption heat pumps each comprising a first heat exchanger assembly 10A of closed structure having a desiccant heat exchanger 1A containing a second desiccant attached to a heat transfer surface, for cooling the desiccant via the heat transfer surface to adsorb a refrigerant or heating the desiccant via the heat transfer surface to desorb (regenerate) the refrigerant, and a refrigerant heat exchanger 3A for evaporating or condensing the refrigerant. The desiccant heat exchanger 1A and the refrigerant heat exchanger 3A communicate with each other via a path. Each adsorption heat pumps further comprises a second heat exchanger assembly 10B. The first heat exchanger assembly 10A and the second heat exchanger assembly 10B communicate with each other via a restriction 7.

The dehumidifying air-conditioning apparatus according to the second embodiment differs from the first embodiment in that the assembly structure 100 is in the shape of a cubic box, the first desiccant and the adsorption heat pumps are fixed, but not rotatable, and paths for air are switched in batches by switching mechanisms for automatically switching a process of adsorbing moisture to and desorbing moisture from the first desiccant and a process of adsorbing a refrigerant to and desorbing a refrigerant from the second desiccant in the adsorption heat pumps.

Specifically, the first desiccant comprises two members 103A, 103B. In the embodiment shown in FIG. 8, the dehumidifying air-conditioning apparatus has a first switching mechanism 201 for allowing the desiccant 103A (103B) to adsorb water in processing air and allowing the other desiccant 103B (103A) to be regenerated by regenerating air, a second switching mechanism 202 for alternately passing the regenerating air and the processing air through the refrigerant heat exchangers 3A, 3B contained in the first and second heat exchanger assemblies 10A, 10B of the adsorption heat pumps, and a third switching mechanism 203 for guiding a heating medium for driving the adsorption heat pumps to the desiccant heat exchangers 1B (1A) directly in communication with the refrigerant heat exchangers 3B (3A) through which the regenerating air flows. The first, second, and third switching mechanisms 201, 202, 203 are ganged to automatically switch the process of adsorbing moisture to and desorbing moisture from the first desiccants 103A, 103B and the process of adsorbing a refrigerant to and desorbing a refrigerant from the second desiccant in the adsorption heat pumps.

In this embodiment, the dehumidifying air-conditioning apparatus has a third sensible heat exchanger 104A (104B) for exchanging heat between a heating medium to pass through the desiccant heat exchangers 1A (1B) of the first (second) heat exchanger assemblies 10A (10B) of the adsorption heat pumps including the refrigerant heat exchangers 3A (3B) which are exchanging heat with the processing air and to be heated by a combustor 5 as a heating source, and the processing air that has passed through the first desiccant 103A (103B), and a fourth sensible heat exchanger 104B (104A) for exchanging heat between the heating medium that has passed through the desiccant heat exchangers 1B (1A) directly in communication with the refrigerant heat exchangers 3B (3A) which are exchanging heat with the regenerating air, and the regenerating air that has passed through the refrigerant heat exchangers 3B (3A) of the second heat exchanger assemblies 10B (10A).

In this embodiment, the dehumidifying air-conditioning apparatus has a heat exchanger 210 for exchanging heat between the regenerating air, discharged air from a joint discharge chamber 170 which collects and discharges the heating medium air, and the regenerating air introduced from outside in order to save the extent to which the regenerating air is heated, and a humidifier 220 for humidifying the heating medium air in front of the heat exchanger 104A (104B) by way of evaporation humidifying or water injection in order to lower the temperature to cool the processing air which has been increased in temperature by the heat of adsorption after being adsorbed and dehumidified by the first desiccant, for thereby increasing a cooling effect.

Operation of the dehumidifying air-conditioning apparatus according to the second embodiment will be described below.

It is assumed, as shown in FIG. 8, that the first switching mechanism 201 is shifted to hold a path 107 and a path 109A in communication with each other and also to hold a path 109B and the joint discharge chamber 170 in communication with each other, the second switching mechanism 202 is shifted to hold a path 127 and a path 152A in communication with each other and also to hold a path 152B and a path 111 in communication with each other, and the third switching mechanism 203 is shifted to hold a path 182 and a path 150A in communication with each other and also to hold a path 150B and the joint discharge chamber 170 in communication with each other.

The adsorption heat pumps constructed according to the second embodiment operate as follows:

In FIG. 8, when the desiccant heat exchanger 1B of the second heat exchanger assembly 10B is heated by heating medium air from outside, which has been heated by a combustor 5, the desiccant generates a refrigerant by depriving the heating medium air of the heat of adsorption, and the refrigerant is condensed by exchanging heat with outside regenerating air with the refrigerant heat exchanger 3B. At this time, the heat of condensation is discharged from the refrigerant heat exchanger 3B into the regenerating air. The condensed refrigerant is reduced in pressure while flowing through a restriction path 7, and flows into the first heat exchanger assembly 10A where it exchanges heat with outside processing air in the refrigerant heat exchanger 3A, so that the refrigerant is evaporated. At this time, the outside processing air is deprived of the heat of evaporation, causing the refrigerant heat exchanger 3A to produce a cooling effect. The evaporated refrigerant is adsorbed by the desiccant of the desiccant heat exchanger 1A which is cooled by other outdoor air (heating medium air). At this time, the heat of adsorption is discharged into the outdoor air (regenerating air) from the desiccant heat exchanger 1A. When the desiccant of the desiccant heat exchanger 1A is saturated by the refrigerant and its adsorption capability is lowered, the third switching mechanism 203 is shifted to bring the path 182 and the path 150B into communication with each other and also to bring the path 150A and the joint discharge chamber 170 into communication with each other, and the first heat exchanger assembly 10A and the second heat exchanger assembly 10B are switched around in operation. Then, the same operation as described above is carried out. In this manner, the cooling effect and the heating effect are successively generated by a batch process.

Figure 10:
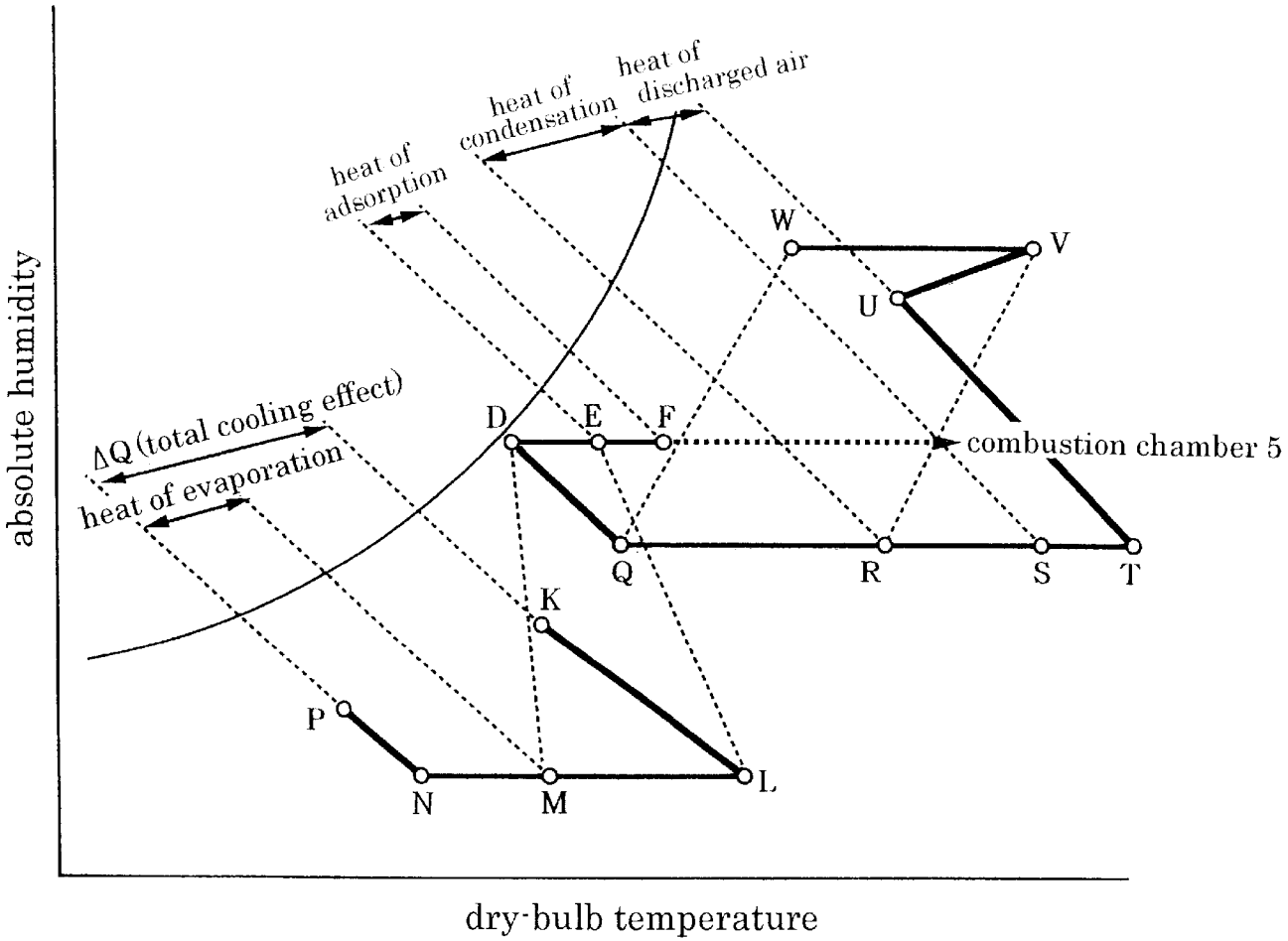
FIG. 10 is a diagram showing the operation of an air cycle of the dehumidifying air-conditioning apparatus according to the second embodiment.

The operation of an air cycle will be described below with reference to FIG. 10. As shown in FIG. 8, according to the second embodiment, recirculating indoor air (RA) is used as the processing air, and outdoor air (OA) is used as the regenerating air and the heating medium air. For desiccant air conditioning, as well known in the art, outdoor air or a mixture of outdoor air and recirculating indoor air may be used as the processing air, and discharged indoor air or a mixture of discharged indoor air and outdoor air may be used as the regenerating air.

The processing air (RA: state K) flows via the path 107, the air blower 102, the first switching mechanism (four-way switching damper) 201, and the path 109A into the assembly structure 100, and is lowered in humidity and increased in temperature (state L) as moisture in the processing air is adsorbed by the first desiccant 103A. The dehumidified air exchanges heat with humidified outdoor air (state D) in the first sensible heat exchanger 104A, and is lowered in temperature (state M). The dehumidified air is then cooled by the refrigerant heat exchanger 3A of the adsorption heat pump that is operating as an evaporator (state N). The dehumidified air flows out of the assembly structure 100 through the path 152B, the second switching mechanism 202, and the path 111 into the humidifier 105. The dehumidified air is humidified in an isenthalpic process by the humidifier 105 (state P), and supplied to the space to be air-conditioned (SA). The regenerating air (state Q) flows through the path 124 and the path 125 into the heat exchanger 210 where it exchanges heat with discharged air (state V) and is increased in temperature (state R). The regenerating air whose temperature has increased is introduced via the path 126, the air blower 140, the path 127, the second switching mechanism 202, and the path 152A into the assembly structure 100, in which the regenerating air is heated by the refrigerant heat exchanger 3B of the second heat exchanger assembly 10B of the adsorption heat pump (state S). The regenerating air flows out of the refrigerant heat exchanger 3B flows into the second sensible heat exchanger 104B in which it exchanges heat with the heating medium air after having heated the desiccant heat exchanger 1B of the second heat exchanger assembly 10B of the adsorption heat pump and is increased in temperature (state T). Thereafter, the regenerating air passes through the second desiccant 103B to regenerate the desiccant, and is humidified and lowered in temperature (state U). The regenerating air that has regenerated the desiccant flows through the path 109B and the first switching mechanism 201 into the joint discharge chamber 170 in which it is combined with the discharged heating medium air (state V). The regenerating air exchanges heat with the regenerating air (state Q) introduced from outside with the heat exchanger 210, and is reduced in temperature (state W), after which it is discarded out as discharged air.

The heating medium air of the adsorption heat pump (state Q) is introduced from outside via the path 124 and flows into the humidifier 220 in which it is humidified and cooled in an isenthalpic process (state D). Thereafter, the heating medium air flows through the air blower 230, the third switching mechanism 203, the path 150A, and an inner passage 151A of the assembly structure 100 into the first sensible heat exchanger 104A in which the heating medium air exchanges heat with the processing air (state L) dehumidified by the desiccant 103A and is increased in temperature (state E). The heating medium air which has left the first sensible heat exchanger 104A flows into the desiccant heat exchanger 1A of the heat exchanger assembly 10A of the adsorption heat pump and is heated by the heat of adsorption of the adsorption heat pump and hence increased in temperature (state F). The heating medium air which has left the desiccant heat exchanger 1A is heated to a high temperature of 160° C. or higher by combustion gases in the combustion chamber 5. The heated heating medium air flows into the desiccant heat exchanger 1B of the second heat exchanger assembly 10B of the adsorption heat pump which is operating as a regenerator. After having heated the desiccant heat exchanger 1B, the heating medium air flows into the second sensible heat exchanger 104B and exchanges heat with the regenerating air of the state S to transfer excessive heat thereto. The heating medium air which has left the sensible heat exchanger 104B flows via an inner passage 151B of the assembly structure 100, the path 150B, and the third switching mechanism 203 into the joint discharge chamber 170 in which it is mixed with the discharged regenerating air of the state U (state V). The heating medium air exchanges heat with the regenerating air (state Q) with the heat exchanger 201, and is discarded out as discharged air.

When the first desiccant is saturated with water such that the adsorption capability of the desiccant 103A is lowered, or the desiccant of the desiccant heat exchanger of the adsorption heat pump is saturated with the refrigerant such that the cooling capability of the refrigerant heat exchanger 3A is lowered, or a preset period of time elapses before the first desiccant is saturated or the desiccant of the desiccant heat exchanger saturated, as shown in FIG. 9, the first switching mechanism 201 is shifted to bring the path 107 and the path 109B into communication with each other and also to bring the path 109A and the joint discharge chamber 170 into communication with each other, the second switching mechanism 202 is shifted to bring the path 127 and the path 152B into communication with each other and also to bring the path 152A and the path 111 into communication with each other, and the third switching mechanism 203 is shifted to bring the path 182 and the path 150B into communication with each other and also to bring the path 150A and the joint discharge chamber 170 into communication with each other, for thereby automatically switching the batch process of dehumidifying and regenerating the desiccant air-conditioning unit and the batch process of adsorbing and desorbing the refrigerant in the adsorption heat pumps for performing successive operation. FIG. 9 shows the paths thus switched over. Since only the paths for the processing air, the regenerating air, and the heating medium air shown in FIG. 9 are different from those shown in FIG. 8, and the operation remains the same, it will not be described below.

According to the second embodiment, as described above, the drive heat applied from outside is used to drive the adsorption heat pumps to produce a cooling effect (states M–N) due to the heat of evaporation of the refrigerant, and the heat discharged from the adsorption heat pumps and the heat recovered from the discharged air (states R–T) are used to regenerate the desiccant of the desiccant air-conditioning unit, adding a cooling effect (states L–M) owing to the desiccant air-conditioning cycles. Therefore, a large energy-saving effect is obtained as with the first embodiment. In this embodiment, furthermore, since the humidified outdoor air (state D) is used as the air for cooling the processing air (state L) that has been adsorbed and dehumidified, the cooling effect between the states L, M is increased, and the cooling effect is higher than the cooling effect according to the first embodiment. In this embodiment, moreover, because heat is recovered from the discharge air by the heat exchanger 210, the extent to which the regenerating air is heated between the states R, T may be small, and the energy efficiency of the desiccant air-conditioning unit is made greater than that of the first embodiment. According to the present invention, therefore, the energy-saving effect and the cooling capability are rendered higher than those of the first embodiment.

With respect to the equipment arrangement, since the required amount of the desiccant and the heat transfer area are the same as those of the first embodiment, and the assembly structure 100 can be constructed in a cubic shape, the external dimensions of the assembly structure 100 represented by longitudinal size, transverse size, and height may be smaller than those of the assembly structure 100 according to first embodiment which is of a circular cross section, the dehumidifying air-conditioning apparatus may be more compact in arrangement.

As the adsorption temperature of the adsorption heat pump and the temperature of the processing air at outlets of the sensible heat exchangers 104A, 104B are lower, the performance of the adsorption heat pump is higher, making greater the cooling effect (states L, M) of the desiccant air-conditioning cycle. Therefore, the heating medium air is introduced from outside in a large mount up to the combustion chamber 5. Specifically, according to the embodiment shown in FIG. 8, the amount of the heating medium air is large through the path 124, the humidifier 220, the air blower 230, the third switching mechanism 203, the path 150A, the path 151A, the first sensible heat exchanger 104A, and the desiccant heat exchanger 1A. Before the heating medium air flows into the combustion chamber 5, part of the heating medium air may be discharged out.

Figure 11:
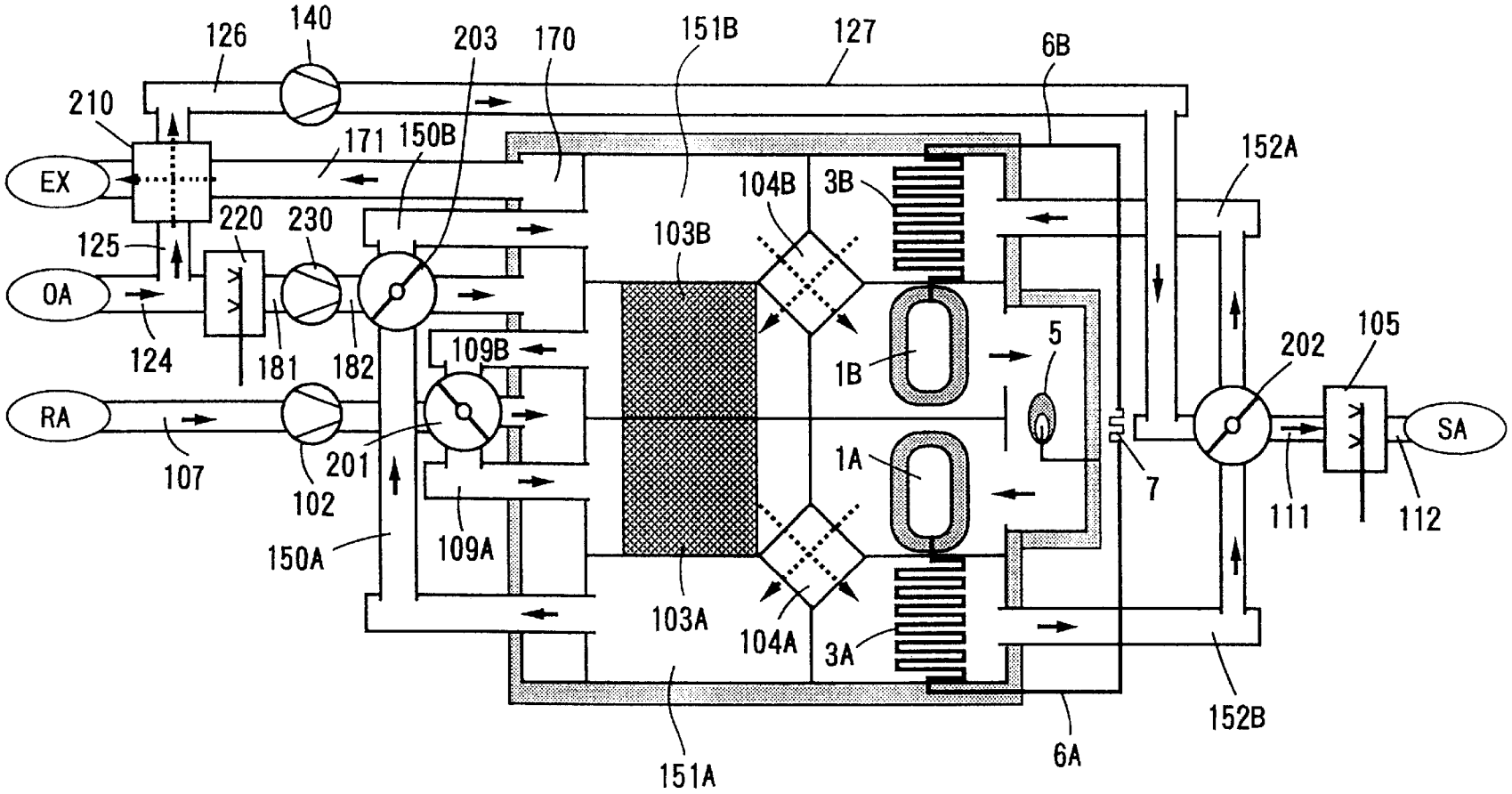
FIG. 11 is a view showing the dehumidifying air-conditioning apparatus according to the second embodiment in a heating mode of operation.
Figure 12:
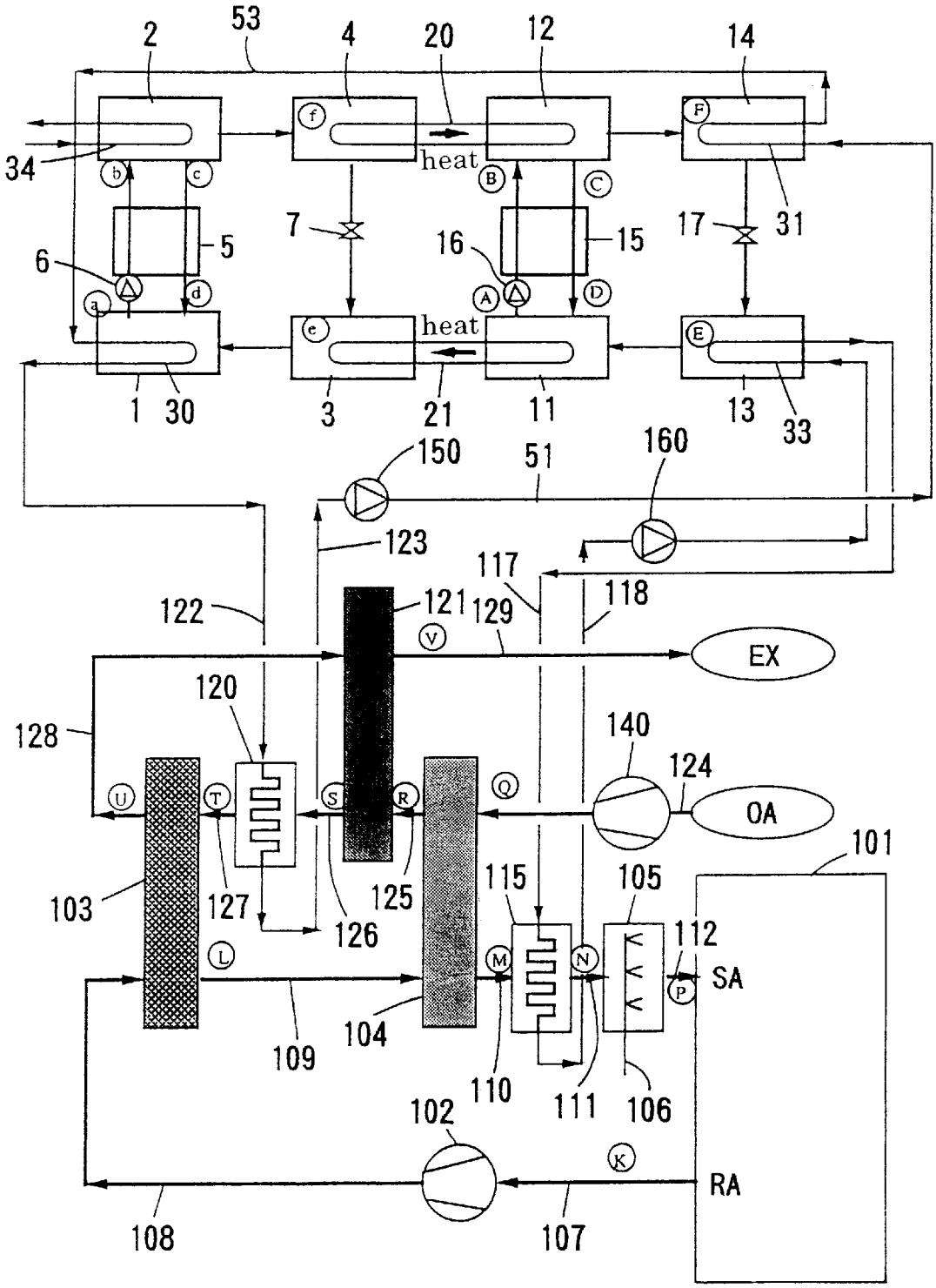
FIG. 12 is a view showing a conventional desiccant air-conditioning unit using an absorption heat pump as a heat source.

FIG. 11 is a view showing the dehumidifying air-conditioning apparatus according to the second embodiment illustrated in FIGS. 8 and 9 in a heating mode of operation.

In the heating mode of operation, unlike the mode shown in FIG. 8, only the third switching mechanism 203 is shifted in a direction different from that in the cooling mode shown in FIG. 8 for guiding the heating medium to the desiccant heat exchanger 1A of the first (or second) heat exchanger assembly of the adsorption heat pump which includes the refrigerant heat exchanger 3A through which indoor air or a mixture of indoor air and outdoor air (flowing in the processing air system in the cooling mode) flows. Specifically, the first switching mechanism 201 is shifted to bring the path 107 and the path 109A into communication with each other and also to bring the path 109B and the joint discharge chamber 170 into communication with each other, the second switching mechanism 202 is shifted to bring the path 127 and the path 152A into communication with each other and also to bring the path 152B and the path 111 into communication with each other, and the third switching mechanism 203 is shifted to bring the path 182 and the path 150B into communication with each other and also to bring the path 150A and the joint discharge chamber 170 into communication with each other.

The heating mode of operation will be described below. The indoor air (RA) (or the mixture of the indoor air and the outdoor air) flowing in the processing air system in the cooling mode flows via the path 107, the air blower 102, the first switching mechanism (four-way switching damper) 201, and the path 109A into the assembly structure 100, and flows into the first desiccant 103A. In the desiccant 103A, the indoor air is humidified if the relative humidity of the indoor air is lower than that of the outdoor air in the regenerating air system that passes through the second desiccant 103B, and the indoor air is dehumidified otherwise. Since the outdoor air is cooled by the adsorption heat pump and passes through the second desiccant 103B after its relative humidity is increased, as described later on, the relative humidity of the outdoor air is liable to be higher than that of the indoor air. On the average, the outdoor air tends to be humidified. The indoor air that has passed through the desiccant 103A flows into the first sensible heat exchanger 104A, and is increased in temperature by exchanging heat with the heating medium air that has heated the desiccant heat exchanger 1A of the heat exchanger assembly 10A of the adsorption heat pump. The indoor air is further heated by the refrigerant heat exchanger 3A of the adsorption heat pump that is operating as a condenser. The indoor air flows out of the assembly structure 100 through the path 152B, the second switching mechanism 202, and the path 111 into the humidifier 105. The indoor air is humidified in an isenthalpic process by the humidifier 105 (state P), and supplied to the space to be air-conditioned (SA).

The outdoor air (or the mixture of the outdoor air and the discharged indoor air) flowing through the regenerating air system goes through the path 124 and the path 125 to the heat exchanger 210 in which it exchanges heat with the discharged air and is increased in temperature. The outdoor air whose temperature has increased flows through the path 126, the air blower 140, the path 127, the second switching mechanism 202, and the path 152A into the assembly structure 100, and is cooled by the refrigerant heat exchanger 3B of the second heat exchanger assembly 10B of the adsorption heat pump that is operating as an evaporator. The outdoor air flows out of the refrigerant heat exchanger 3B into the second sensible heat exchanger 104B, is further lowered in temperature by exchanging heat with the heating medium air introduced from outside, and thereafter passes through the second desiccant 103B. If the relative humidity of the outdoor air flowing through the regenerating air system is higher than that of the indoor air flowing through the processing air system, then the water content of the outdoor air is adsorbed by the second desiccant 103B. Otherwise, the outdoor air is humidified by the second desiccant 103B. The regenerating air which has passed through the desiccant goes through the path 109B and the first switching mechanism 201 into the joint discharge chamber 170, is combined with the discharged heating medium air and increased in temperature, and thereafter is reduced in temperature by exchanging heat with the regenerating air introduced from outside by the heat exchanger 210, and then discarded as discharged air.

The heating medium air (state Q) of the adsorption heat pump is introduced from outside via the path 124 and flows into the humidifier 220. Since the humidifier 220 is not in operation in the heating mode, the heating medium air passes as it is through the humidifier 220, and goes through the air blower 230, the third switching mechanism 203, the path 150B, and the inner passage 151B of the assembly structure 100 into the second sensible heat exchanger 104B in which the heating medium air exchanges heat with the outdoor air in the regenerating air system which has been cooled by the refrigerant heat exchanger 3B of the second heat exchanger assembly 10B of the adsorption heat pump. The heating medium air which has left the second sensible heat exchanger 104B flows into the desiccant heat exchanger 1B of the second heat exchanger assembly 10B of the adsorption heat pump which is operating as an adsorber, and is heated by the heat of adsorption of the adsorption heat pump and further increased in temperature. The heating medium air which has flowed out of the desiccant heat exchanger 1B is heated to a high temperature of 160° C. or higher by combustion gases in the combustion chamber 5. The heated heating medium air flows into the desiccant heat exchanger 1A of the first heat exchanger assembly 10A of the adsorption heat pump which is operating as a regenerator, and then flows into the first sensible heat exchanger 104A and exchanges heat with the indoor air in the regenerating air system to transfer excessive heat thereto. The heating medium air then flows out of the sensible heat exchanger 104A through the inner passage 151A of the assembly structure 100, the path 150A, and the third switching mechanism 203 into the joint discharge chamber 170 in which the heating medium air is mixed with the outdoor air flowing in the regenerating air system to exchange heat with the outdoor air flowing in the regenerating air system in the heat exchanger 201. Thereafter, the heating medium air is discarded out as discharged air.

When the desiccant of the desiccant heat exchanger of the adsorption heat pump is saturated with the refrigerant such that the cooling capability of the refrigerant heat exchanger 3B is lowered, or a preset period of time elapses before the desiccant of the desiccant heat exchanger saturated, the first switching mechanism 201 is shifted to bring the path 107 and the path 109B into communication with each other and also to bring the path 109A and the joint discharge chamber 170 into communication with each other, the second switching mechanism 202 is shifted to bring the path 127 and the path 152B into communication with each other and also to bring the path 152A and the path 111 into communication with each other, and the third switching mechanism 203 is shifted to bring the path 182 and the path 150A into communication with each other and also to bring the path 150B and the joint discharge chamber 170 into communication with each other, for thereby automatically switching the batch process of dehumidifying and regenerating the first desiccant and the batch process of adsorbing and desorbing the refrigerant in the adsorption heat pumps for performing successive operation.

In the heating mode of operation, therefore, the air which has been heated and humidified can be supplied to the air-conditioned room via the same path as the air used in the cooling mode.

According to the present invention, as described above, the so-called hybrid desiccant air-conditioning (dehumidifying air-conditioning) apparatus includes a path for processing air from which moisture is adsorbed by the desiccant open to the atmosphere and cooled by a low heat source of a heat pump and a path for regenerating air which is heated by a high temperature heat source of the heat pump and thereafter passes through a first desiccant that has adsorbed the moisture to desorb the moisture from the first desiccant, the arrangement being such that the processing air and the regenerating air flow alternately through the first desiccant, the hybrid desiccant air-conditioning apparatus including, as the heat pump, an adsorption heat pump having first and second heat exchanger assemblies of closed structure in each of which a desiccant heat exchanger with a closed-type desiccant for adsorbing or desorbing (regenerating) a refrigerant and a refrigerant heat exchanger for evaporating or condensing the refrigerant communicate with each other via a path, the refrigerant heat exchangers of the first and second heat exchanger assemblies communicating with each other via a path through a restriction, the arrangement being such that the processing air and the regenerating air flow alternately through the refrigerant heat exchangers of the first and second heat exchanger assemblies of the adsorption heat pumps, and a heating medium for driving the adsorption heat pumps is guided to and heated by the desiccant heat exchangers directly in communication with the refrigerant heat exchangers through which the regenerating air flows, the major components being housed as an assembly structure in a compact casing, and a process of desorbing moisture from the desiccant of the desiccant air-conditioning apparatus and a process of adsorbing and desorbing the refrigerant of the adsorption heat pumps are automatically switched. The dehumidifying air-conditioning apparatus can simply be operated, is highly reliable, highly energy-saving, and compact, and can flexibly cope with both cooling and heating modes of operation.

INDUSTRIAL APPLICABILITY

The present invention is preferably applicable to an air-conditioning apparatus for use in general houses or larger buildings such as of supermarkets, offices, and others.

What is claimed is:

1. A dehumidifying air-conditioning apparatus comprising a path for processing air from which moisture is adsorbed by a first desiccant and thereafter cooled by a low temperature heat source of a heat pump and a path for regenerating air which is heated by a high temperature heat source of the heat pump and thereafter passes through the first desiccant that has adsorbed the moisture to desorb the moisture from the first desiccant, the arrangement being such that the processing air and the regenerating air flow alternately through the first desiccant, characterized by:

at least one adsorption heat pump, as the heat pump, having first and second heat exchanger assemblies of closed structure each having a desiccant heat exchanger with a second desiccant for adsorbing or desorbing a refrigerant and a refrigerant heat exchanger for evaporating or condensing the refrigerant, said refrigerant heat exchangers of the first and second heat exchanger assemblies communicating with each other via a path through a restriction;

the arrangement being such that the processing air and the regenerating air flow alternately through the refrigerant heat exchangers of the first and second heat exchanger assemblies of the adsorption heat pumps, and a heating medium for driving the adsorption heat pumps is guided to and heated by the desiccant heat exchangers directly in communication with the refrigerant heat exchangers through which the regenerating air flows.

2. A dehumidifying air-conditioning apparatus according to claim 1, characterized in that said first desiccant comprises a rotor rotatable about a central shaft relative to the fixed paths for the processing air and the regenerating air for allowing the processing air and the regenerating air to flow alternately therethrough, said first heat exchanger assembly and said second heat exchanger assembly being radially provided in at least one pair symmetrically with respect to the central shaft and rotatable about the central shaft, the adsorption heat pump which comprises said first heat exchanger assembly and said second heat exchanger assembly being rotatable relatively to the fixed paths for the processing air and the regenerating air and a path for a heat medium as a heating source to allow said regenerating air and said processing air to flow alternately through the refrigerant heat exchangers of said first and second heat exchanger assemblies and also to guide the heating medium to the desiccant heat exchanger of said first or second heat exchanger assembly which includes the refrigerant heat exchanger through which the regenerating air flows, for thereby automatically switching a process of adsorbing moisture to and desorbing moisture from the first desiccant and a process of adsorbing a refrigerant to and desorbing a refrigerant from the second desiccant in the adsorption heat pump.

3. A dehumidifying air-conditioning apparatus according to claim 1, characterized by a first sensible heat exchanger for exchanging heat between the regenerating air passing through the desiccant heat exchanger directly in communication with the refrigerant heat exchanger which is exchanging heat with the processing air, and the processing air which has passed through the first desiccant, and a second sensible heat exchanger for exchanging heat between the heating medium which has passed through the desiccant heat exchanger of the second heat exchanger assembly of the adsorption heat pump which is positioned in symmetric relationship to said first heat exchanger assembly including the refrigerant heat exchanger which is exchanging heat with the regenerating air, and the regenerating air which has passed through the refrigerant heat exchanger of the second heat exchanger assembly.

4. A dehumidifying air-conditioning apparatus according to claim 3, characterized by:

a first cylindrical casing which houses therein said first desiccant, a heat transfer surface, of a heat transfer surface of said first sensible heat exchanger, for contacting the processing air which has passed through the first desiccant, a heat transfer surface, of a heat transfer surface of said second sensible heat exchanger, for contacting the regenerating air which has passed through the refrigerant heat exchanger of the second heat exchanger assembly, and the refrigerant heat exchangers of the first and second heat exchanger assemblies;

a second cylindrical casing surrounding said first cylindrical casing and having the same central axis as the first cylindrical casing and a diameter greater than the diameter of the first cylindrical casing, said first cylindrical casing and said second cylindrical casing defining a space therein which houses therein a heat transfer surface, of the heat transfer surface of said first sensible heat exchanger, for contacting the regenerating air which is to pass through the desiccant heat exchanger of the first heat exchanger assembly of the adsorption heat pump, a heat transfer surface, of the heat transfer surface of said second sensible heat exchanger, for contacting the heating medium of the adsorption heat pump which has passed through the desiccant heat exchanger of the second heat exchanger assembly of the adsorption heat pump, and the desiccant heat exchangers of the first and second heat exchanger assemblies of the adsorption heat pump; and a partition disposed at ends of and within the first cylindrical casing and separating the paths for the processing air and the regenerating air which pass through the first desiccant, and partitions disposed at ends of and within the space defined between said first cylindrical casing and said second cylindrical casing and separating the paths for the heating medium and the regenerating air;

all components which are surrounded by said second cylindrical casing being assembled as an assembly structure, the arrangement being such that the processing air flows into the assembly structure, passes successively through the first desiccant, the first sensible heat exchanger, and the refrigerant heat exchanger of the first heat exchanger assembly of the adsorption heat pump, and then flows out of the assembly structure into a space to be air-conditioned;

the arrangement being such that the regenerating air flows into the path for the regenerating air in the space defined between the first and second cylindrical casings of said assembly structure, passes successively through the first sensible heat exchanger and the desiccant heat exchanger of the first heat exchanger assembly of the adsorption heat pump, then flows into the path for the regenerating air in the first cylindrical casing, passes successively through the refrigerant heat exchanger of the second heat exchanger assembly of the adsorption heat pump, the second sensible heat exchanger, and the first desiccant, and flows out of the assembly structure;

the arrangement being such that the heating medium of the adsorption heat pump is heated by a heat source, flows into the path for the heating medium in the space defined between the first and second cylindrical casings of said assembly structure, passes successively through the desiccant heat exchanger of the second heat exchanger assembly of the adsorption heat pump and the second sensible heat exchanger, and flows out of the assembly structure; and the arrangement being such that at least the first desiccant and the first and second heat exchanger assemblies of the adsorption heat pump which are installed in said assembly structure are rotatable relatively to the paths for the processing air and the regenerating air and the heating medium of the adsorption heat pump in the assembly structure.

5. A dehumidifying air-conditioning apparatus according to claim 4, characterized in that said first and second sensible heat exchangers comprise a plurality of heat pipes and are arranged radially about the central axis of the cylindrical casings such that the heat transfer surfaces are exposed to a space in the first cylindrical casing and the space defined between the first and second cylindrical casings.

6. A dehumidifying air-conditioning apparatus according to any one of claims 1 through 5, characterized in that at least a portion of the regenerating air which has regenerated the desiccant is heated for use as the heating medium of the adsorption heat pump.

7. A dehumidifying air-conditioning apparatus according to claim 1, characterized in that said first desiccant comprises at least two members, further comprising a first switching mechanism for allowing one of the members of the first desiccant to adsorb moisture in the processing air and the other of the members of the first desiccant to be regenerated by the regenerating air, a second switching mechanism for passing said regenerating air and said processing air alternately through the refrigerant heat exchangers of the first and second heat exchanger assemblies of the adsorption heat pump, and a third switching mechanism for guiding the heating medium to drive the adsorption heat pump to the desiccant heat exchanger directly in communication with the refrigerant heat exchanger through which the regenerating air flows, said first, second, and third switching mechanisms being ganged for automatically switching a process of adsorbing moisture to and desorbing moisture from the first desiccant and a process of adsorbing a refrigerant to and desorbing a refrigerant from the second desiccant in the adsorption heat pump.

8. A dehumidifying air-conditioning apparatus according to claim 7, characterized by a third sensible heat exchanger for exchanging heat between the heating medium to pass through the desiccant heat exchanger directly in communication with the refrigerant heat exchanger which is exchanging heat with the processing air and to be heated by a heating source, and the processing air which has passed through the first desiccant, and a fourth sensible heat exchanger for exchanging heat between the heating medium that has passed through the desiccant heat exchanger directly in communication with the refrigerant heat exchanger which is exchanging heat with the regenerating air, and the regenerating air that has passed through the refrigerant heat exchanger of the second heat exchanger assembly.

9. A dehumidifying air-conditioning apparatus according to claim 7 or 8, which operates with indoor air or a mixture of indoor air and outdoor air as the processing air, and also with outdoor air or a mixture of outdoor air and discharged indoor air as the regenerating air and the heating medium.

10. A dehumidifying air-conditioning apparatus according to claim 9, characterized in that said third switching mechanism is shifted in a direction different from a mode of operation according to claim 9, for guiding the heating medium to the desiccant heat exchanger directly in communication with the refrigerant heat exchanger through which the indoor air or the mixture of the indoor air and the outdoor air flows to heat the space to be air-conditioned.

* * * * *